US009070517B2

(12) United States Patent
Bullock et al.

(10) Patent No.: US 9,070,517 B2
(45) Date of Patent: Jun. 30, 2015

(54) VACUUM INTERRUPTER AND LINEAR DISCONNECT SWITCH

(71) Applicant: Electro-Mechanical Corporation, Bristol, VA (US)

(72) Inventors: Scott A. Bullock, Bristol, VA (US); Garry F. Raines, Bristol, TN (US)

(73) Assignee: Electro-Mechanical Corporation, Bristol, TN (US)

( * ) Notice: Subject to any disclaimer, the term of this patent is extended or adjusted under 35 U.S.C. 154(b) by 67 days.

(21) Appl. No.: 13/833,512

(22) Filed: Mar. 15, 2013

(65) Prior Publication Data

US 2014/0043119 A1 Feb. 13, 2014

Related U.S. Application Data

(60) Provisional application No. 61/682,489, filed on Aug. 13, 2012.

(51) Int. Cl.
*H01H 33/66* (2006.01)
*H01H 9/20* (2006.01)
(Continued)

(52) U.S. Cl.
CPC ..... *H01H 9/20* (2013.01); *H01H 31/32* (2013.01); *H01H 33/6661* (2013.01); *H01H 33/6662* (2013.01)

(58) Field of Classification Search
CPC ..... H02B 11/00; H02B 11/02; H02B 11/127–11/133; H02B 11/18; H02B 7/01; H02B 13/035; H02B 13/0352–13/0358
USPC ..... 218/5, 14, 17, 19, 118–120, 152–153
See application file for complete search history.

(56) References Cited

U.S. PATENT DOCUMENTS 1,113,087 A * 10/1914 Ball ..... 218/101
2,449,221 A 9/1948 Hammerly
(Continued)

FOREIGN PATENT DOCUMENTS

EP 1548778 A1 6/2005
EP 2244275 A1 10/2010
(Continued)

OTHER PUBLICATIONS

Tavrida Electric "LD Series Circuit Breakers" internet web page http://tavrida-na.com/cb_ld-htm. Retrieved Nov. 31, 2011.
(Continued)

*Primary Examiner* — Alexander Talpalatski
(74) *Attorney, Agent, or Firm* — Luedeka Neely Group, P.C.

(57) ABSTRACT

Switchgear which combines a visible disconnect switch and a circuit breaker or interrupter capable of interrupting fault currents. The switchgear includes a carriage and a switch actuator connected to the carriage for moving the carriage between a switch-closed position and a switch-open position. A circuit breaker module includes circuit breaker contacts, as well as first and second contactor terminals. The circuit breaker module provides selective electrical connection between the contactor terminals depending on the state of the circuit breaker contacts. A fixed disconnect switch contact us attached to or comprises one of the first and second contactor terminals, and a movable disconnect switch contact is mounted to the carriage so as to move with the carriage. The fixed disconnect switch contact and the movable disconnect switch contact are positioned for selective engagement with each other as the carriage moves to the switch-closed position.

15 Claims, 18 Drawing Sheets

(51) Int. Cl.
*H01H 31/32* (2006.01)
*H01H 33/666* (2006.01)

(56) References Cited

U.S. PATENT DOCUMENTS

| | | | | |
|---|---|---|---|---|
| 2,455,998 | A * | 12/1948 | Hoye | 218/13 |
| 3,374,331 | A * | 3/1968 | Brockhaus et al. | 218/1 |
| 3,751,617 | A * | 8/1973 | Bohlinger et al. | 218/118 |
| 4,090,230 | A | 5/1978 | Fuller et al. | |
| 4,427,854 | A | 1/1984 | Kleinecke et al. | |
| 4,447,858 | A | 5/1984 | Farag et al. | |
| 4,449,021 | A * | 5/1984 | Wakayama et al. | 218/119 |
| 4,482,936 | A | 11/1984 | Saito | |
| 4,484,046 | A | 11/1984 | Neuhouser | |
| 4,541,033 | A | 9/1985 | Saito | |
| 5,097,382 | A | 3/1992 | Leach et al. | |
| 5,684,282 | A * | 11/1997 | Castonguay et al. | 200/50.21 |
| 5,767,440 | A | 6/1998 | Byron et al. | |
| 5,912,604 | A * | 6/1999 | Harvey et al. | 335/9 |
| 6,198,062 | B1 * | 3/2001 | Mather et al. | 218/152 |
| 6,225,581 | B1 | 5/2001 | Gerbert-Gaillard et al. | |
| 6,285,270 | B1 | 9/2001 | Lane et al. | |
| 6,313,424 | B1 * | 11/2001 | Bachofen | 218/6 |
| 6,410,874 | B2 * | 6/2002 | Marin-Pache et al. | 218/118 |
| 6,803,844 | B2 * | 10/2004 | Bach et al. | 335/202 |
| 7,277,294 | B2 | 10/2007 | Carlson | |
| 7,821,775 | B2 | 10/2010 | Narayanasamy et al. | |
| 7,902,480 | B2 * | 3/2011 | Tsuchiya et al. | 218/120 |
| 2005/0139579 | A1 | 6/2005 | Sakamoto et al. | |
| 2008/0308531 | A1 * | 12/2008 | Tsuchiya et al. | 218/118 |
| 2010/0170874 | A1 * | 7/2010 | Tsuchiya et al. | 218/118 |

FOREIGN PATENT DOCUMENTS

| | | | |
|---|---|---|---|
| GB | 1107855 | | 3/1968 |
| GB | 2311654 | A | 10/1997 |
| RU | 2020631 | C1 | 9/1994 |
| RU | 2249874 | C2 | 4/2005 |
| WO | 2004086437 | A1 | 10/2004 |
| WO | 2011020509 | A | 2/2011 |

OTHER PUBLICATIONS

Tavrida Product Brochure downloaded from tavrida-na.com/downloads.htm (2011).

Two-page brochure titled "27kV Vacuum Circuit Breaker" describing one of applicant's prior devices combining a visible disconnect switch and an interrupter in the form of a vacuum circuit breaker. Date is prior to Jan. 23, 2011.

International Search Report prepared by the European Patent Office as International Searching Authority in corresponding application PCT/US2013/054265 mailed Nov. 21, 2013.

* cited by examiner

VACUUM INTERRUPTER AND LINEAR DISCONNECT SWITCH

CROSS-REFERENCE TO RELATED APPLICATION

The benefit of U.S. provisional patent application Ser. No. 61/682,489 filed Aug. 13, 2012 is claimed, the entire disclosure of which is hereby expressly incorporated by reference.

BACKGROUND OF THE INVENTION

The invention relates generally to electrical switchgear, such as electrical feeder circuit protectors including an electrical contactor, and, more particularly, to switchgear which combines a visible disconnect switch (typically but not necessarily manually-operated) and a circuit breaker (which may also be termed an interrupter) capable of interrupting fault currents.

SUMMARY OF THE INVENTION

In one aspect, switchgear is provided which includes a carriage and a switch actuator connected to the carriage for moving the carriage between a switch-closed position and a switch-open position. A circuit breaker module includes circuit breaker contacts, as well as first and second contactor terminals. The circuit breaker module provides selective electrical connection between the contactor terminals depending on the state of the circuit breaker contacts. A fixed disconnect switch contact is attached to or comprises one of the first and second contactor terminals, and a movable disconnect switch contact is mounted to the carriage so as to move with the carriage. The fixed disconnect switch contact and the movable disconnect switch contact are positioned for selective engagement with each other as the carriage moves to the switch-closed position.

In another aspect, switchgear is provided which includes a carriage and a switch actuator connected to the carriage for moving the carriage between a switch-closed position and a switch-open position. A circuit breaker module includes circuit breaker contacts which are opened and closed by an electrically-activated magnetic actuator. The circuit breaker module includes first and second contactor terminals and provides selective electrical connection between the contactor terminals depending on the state of the circuit breaker contacts. The magnetic actuator is stable in either a breaker-closed state or a breaker-open state without requiring electrical current flow through the magnetic actuator. The circuit breaker module also includes an externally-connectable mechanical drive linked to the magnetic actuator in a manner such that movement of the externally-connectable mechanical drive can destabilize the breaker-closed state to open the circuit breaker contacts. The circuit breaker module includes an insulating tower generally cylindrical in configuration defining a longitudinal axis, and having a top. A fixed disconnect switch contact is attached to or is one of the first and second contactor terminals, the one of the first and second contactor terminals being located at the top of the tower; and a movable disconnect switch contact is mounted to the carriage so as to move with the carriage. Another of the first and second contactor terminals is located on a cylindrical side of the tower. The fixed disconnect switch contact and the movable disconnect switch contact are positioned for selective engagement with each other as the carriage moves to the switch-closed position.

DETAILED DESCRIPTION

FIGS. 1A, 1B, 1C and 1D illustrate a circuit breaker module 20 having particular characteristics, described hereinbelow, which are utilized in embodiments of the subject invention. (Depending on the context, a circuit breaker may also be termed an interrupter. For purposes of this disclosure, the two terms have the same meaning.)

Figure 11:
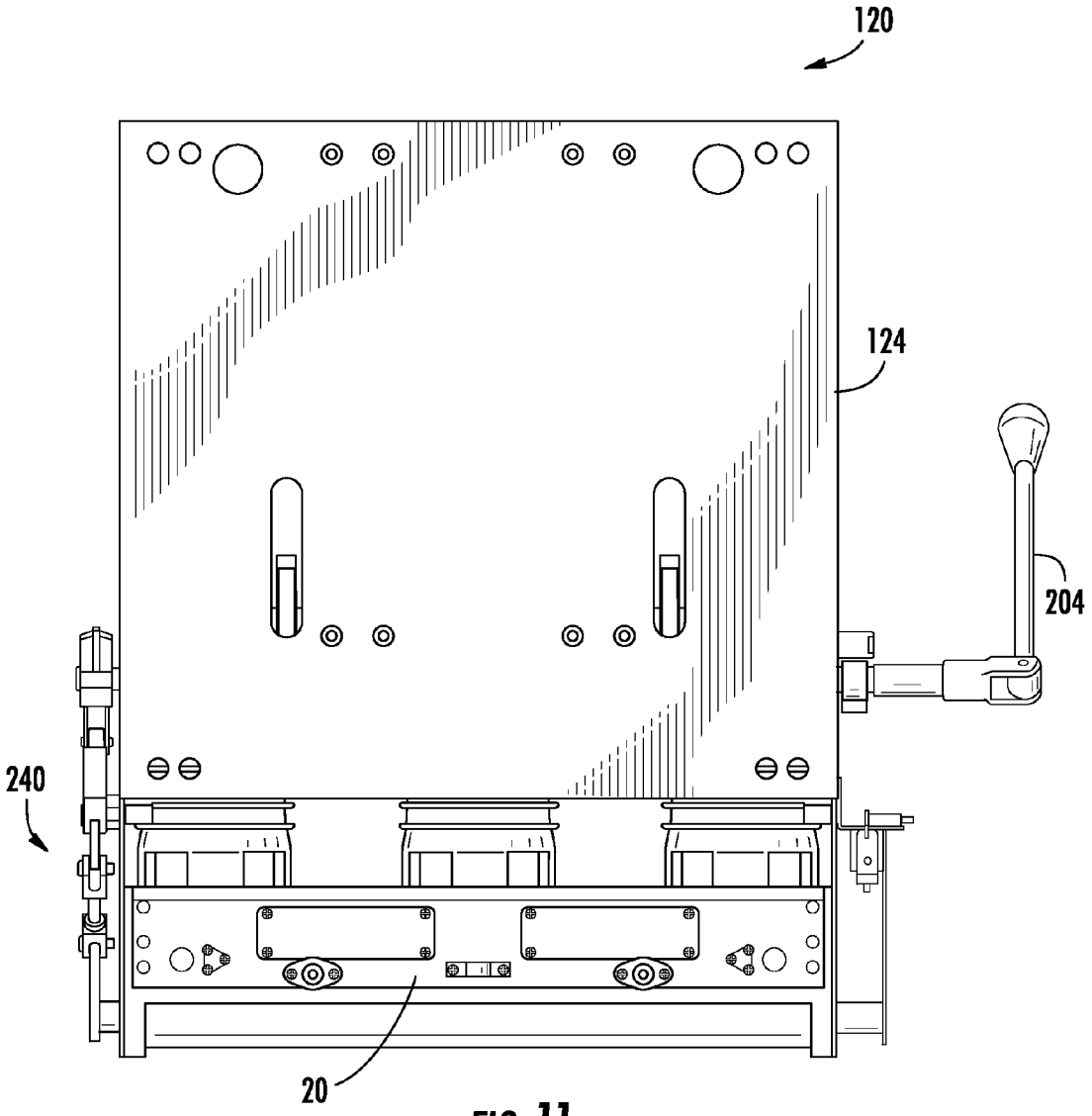
FIG. 11 is a rear elevational view, in the same orientation as FIG. 6, of the switchgear embodying the invention in the second configuration or state.

By way of example and not limitation, the particular circuit breaker module 20 illustrated in FIGS. 1A-1D is an "LD Series" circuit breaker module manufactured by Tavrida Electric, and available through their North American office located on Annacis Island, Delta, British Columbia, Canada, internet website tavrida-na.com. "LD Series" circuit breaker modules are available in 5 kV, 15 kV, and 27 kV sizes. The circuit breaker module 20 is similar to, and employs the same principles as a circuit breaker module disclosed in international patent application Publication No. WO 2004/086437 A1, titled "Vacuum Circuit Breaker," and naming as applicant Tavrida Electrical Industrial Group, Moscow, Russia, the entire disclosure of which is hereby expressly incorporated by reference. A typical installation includes a control module 22 (represented in FIGS. 11 and 12) which generates current pulses to provide close and open (trip) functionality. However, a characteristic of the circuit breaker module 20 is that it is stable in either a breaker-closed state or a breaker-open state without requiring continuous electrical energization, such as from the control module 22. (An example of a control module is a Tavrida Electric model CM-15-1 electronic control module.)

The circuit breaker module 20 includes a base 24 which serves as a lower housing or enclosure for various components, and three individual phase modules 26, 28 and 30 partially secured within and extending upwardly from the base 24. Although a three-phase circuit breaker module 20 is illustrated, and embodiments of the invention illustrated and described herein employ a three-phase circuit breaker module, such is by way of example and not limitation. The invention may, for example, be embodied in single-phase switchgear employing a single-phase circuit breaker.

The three-phase modules 26, 28 and 30 are essentially identical. Accordingly, only phase module 26 is described in detail hereinbelow, as representative.

Figure 1A:
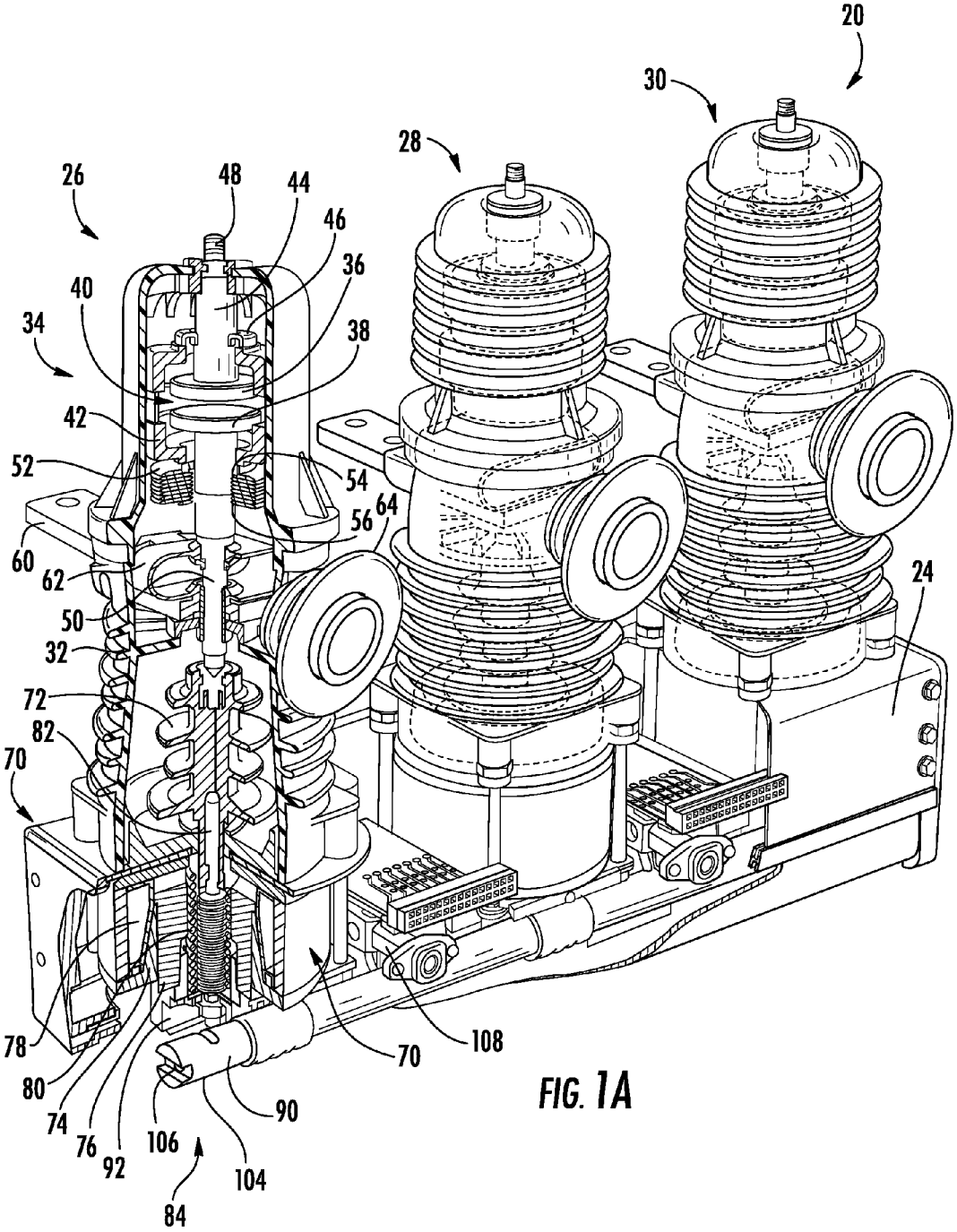
FIG. 1A is a three-dimensional view of an "LD Series" circuit breaker manufactured by Tavrida Electric.

The phase module 26 includes an outer insulating tower 32, and a vacuum circuit breaker, generally designated 34, within an upper portion of the insulating tower 32. The vacuum circuit breaker 34 more particularly includes a fixed upper circuit breaker contact 36 and a movable lower circuit breaker contact 38 which open and close during operation. In the configuration of FIG. 1A, the circuit breaker contacts 36 and 38 are open, separated by a gap of approximately three-eighths inch (1 cm). The circuit breaker contacts 36 and 38 are within a vacuum chamber 40 defined in part by a generally cylindrical ceramic body 42.

The fixed upper circuit breaker contact 36 is electrically connected to an upper terminal structure 44 which passes through a seal 46 at the top of the vacuum chamber 40, terminating in an upper screw terminal 48 at the top of the outer insulating tower 32.

The movable lower circuit breaker contact 38 is mechanically and electrically connected to a conductive rod 50 which exits the bottom of the vacuum chamber 40, sealed by a bellows-like flexible diaphragm 52 so that the conductive rod 50 can translate up and down. The diaphragm 52 is annularly sealed at its upper end 54 to the ceramic body 42 of the vacuum chamber 40, and annularly sealed at its lower end 56 to the conductive rod 50. Accordingly, the conductive rod 50 and thus the movable lower circuit breaker contact 38 can move up and down to close and open the circuit breaker contacts 36 and 38, while maintaining vacuum within the vacuum chamber 40.

The conductive rod 50 is electrically connected to a side terminal 60 of the phase module 26 via a flexible junction shunt 62. Thus, the upper screw terminal 48 and the side terminal 60 serve as external high voltage terminals of the phase module 26.

Figure 1B:
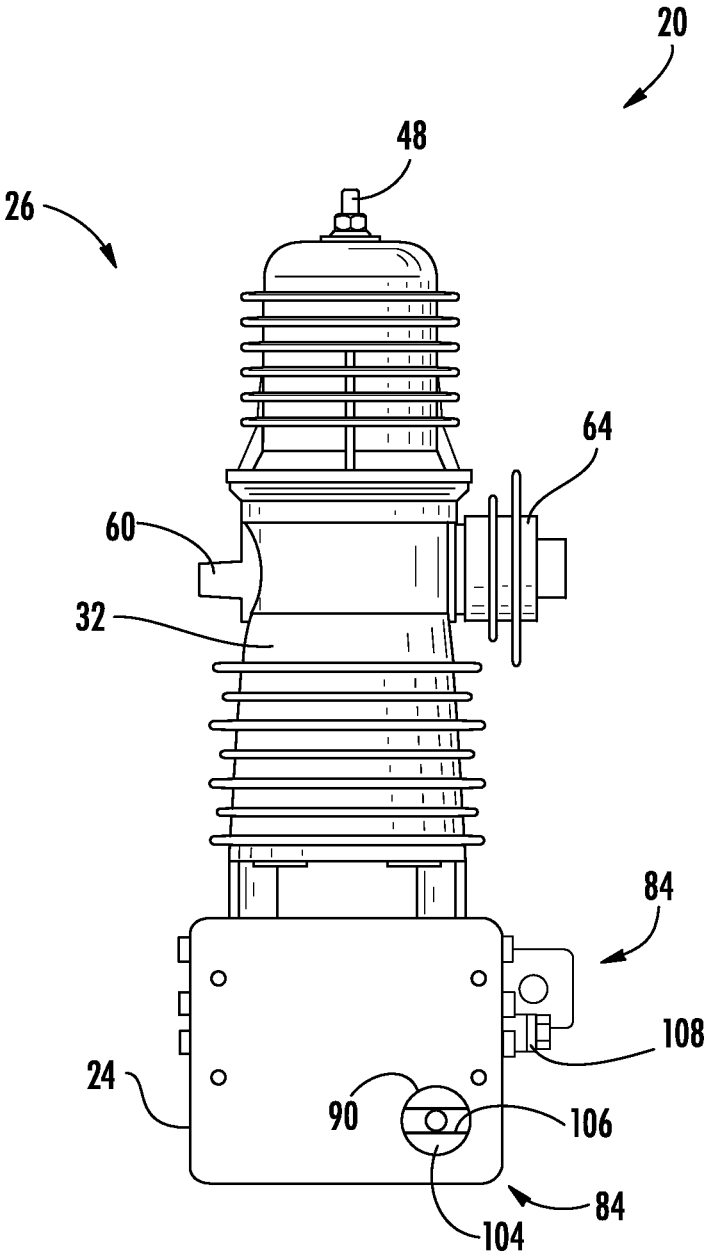
FIG. 1B is an end elevational view of the circuit breaker of FIG. 1A.
Figure 1C:
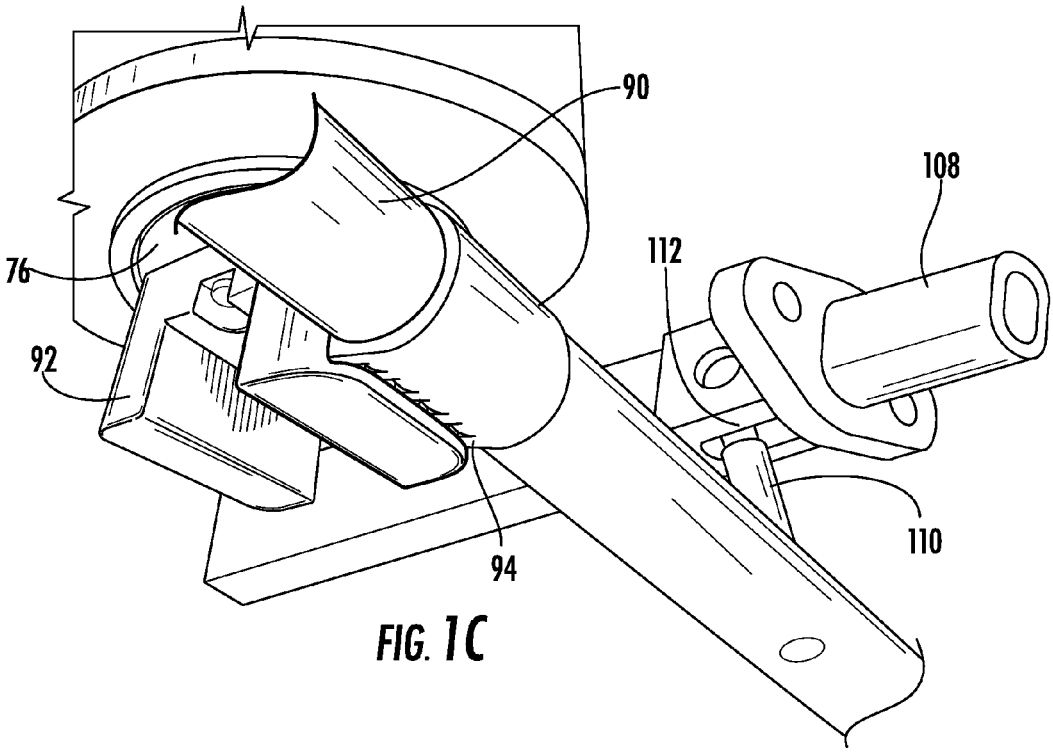
FIG. 1C is a three-dimensional underside view of a portion of the circuit breaker of FIG. 1A.
Figure 1D:
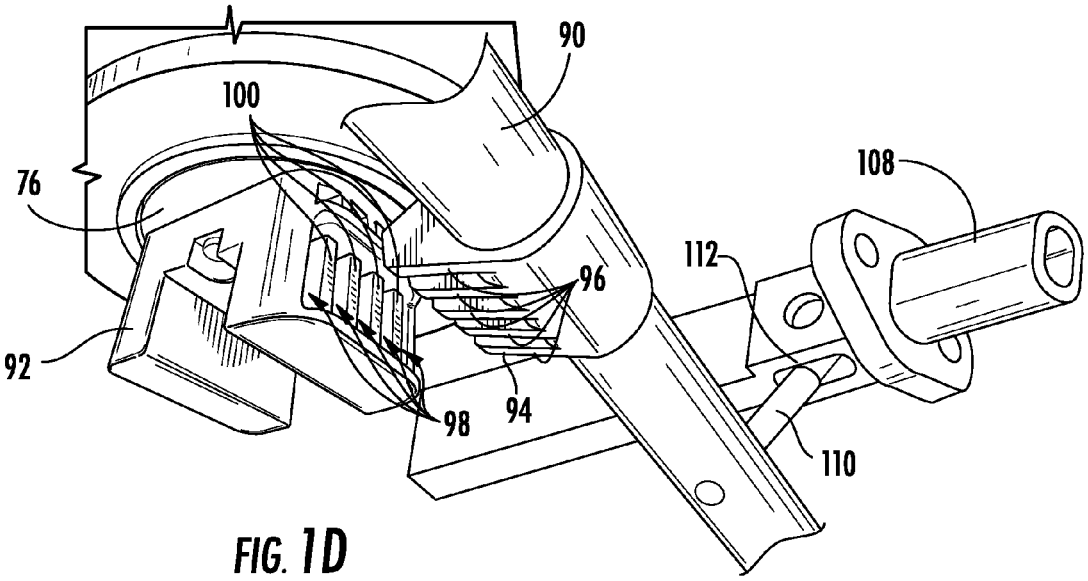
FIG. 1D is a partially exploded three-dimensional view corresponding to the view of FIG. 1C.
Figure 2:
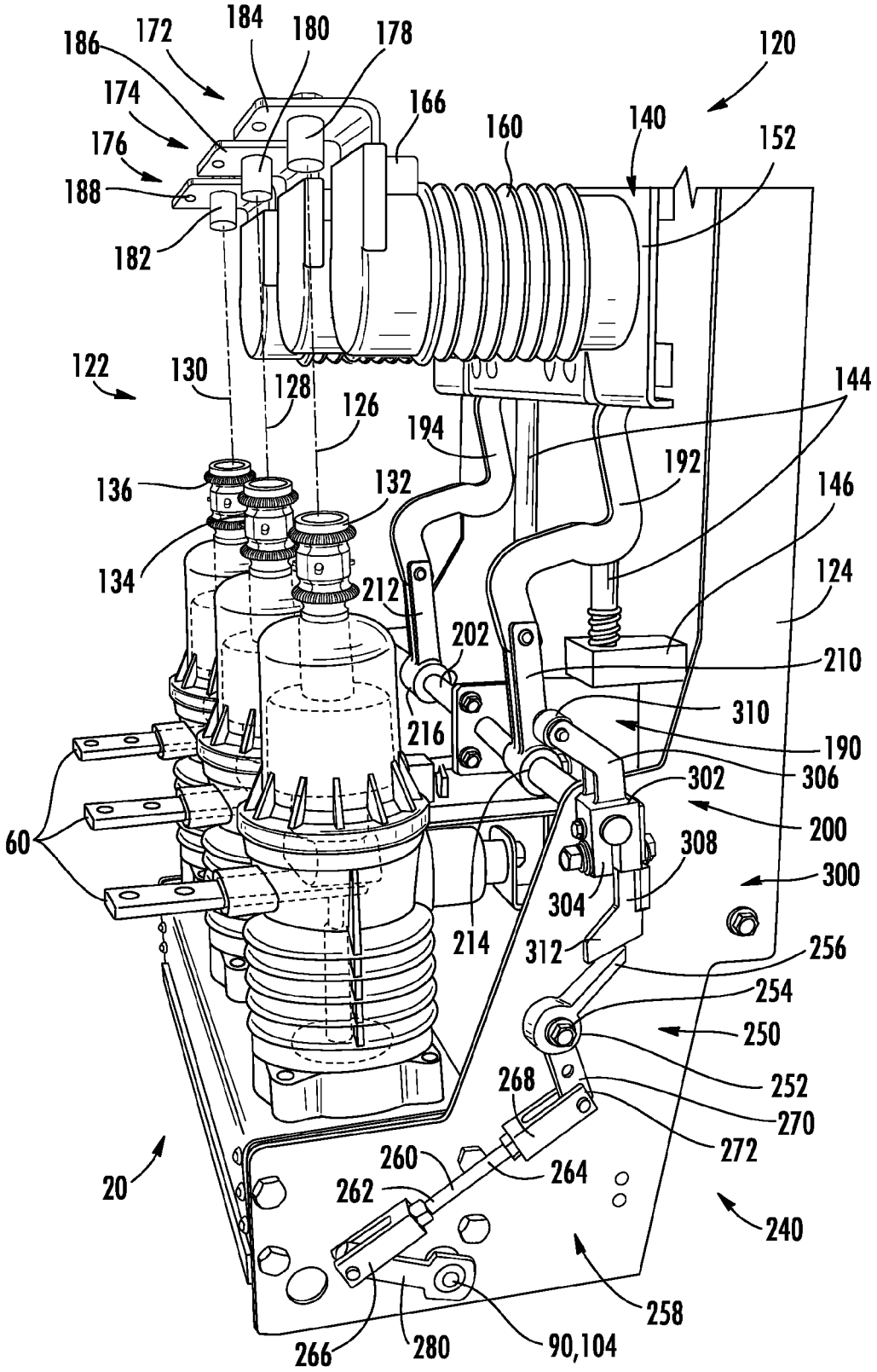
FIG. 2 is a right side three-dimensional view of switchgear embodying the invention in a first configuration or state, wherein the disconnect switch and interrupter are both open.
Figure 3:
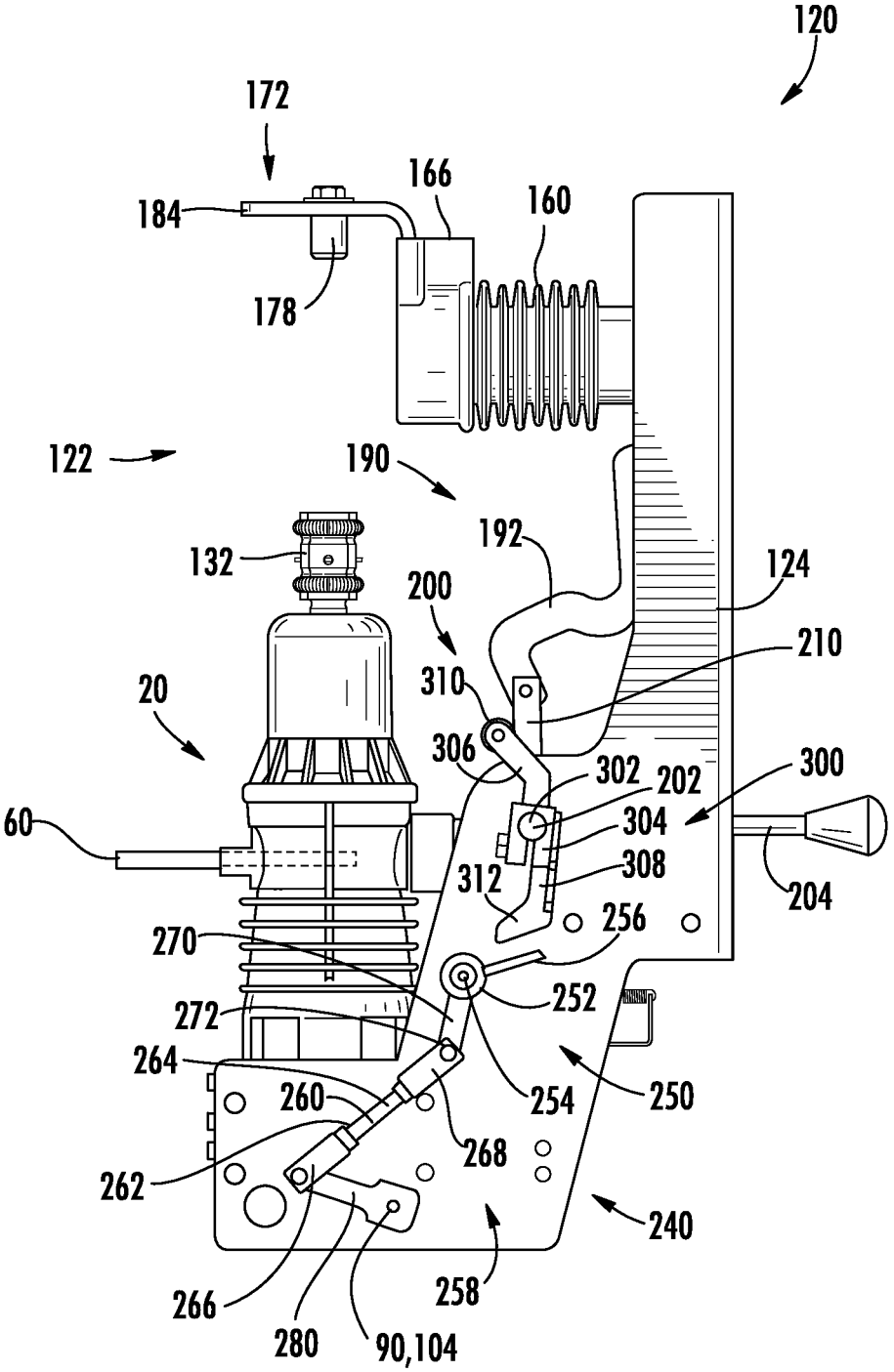
FIG. 3 is a right side elevational view of the switchgear embodying the invention in its first configuration or state.
Figure 4:
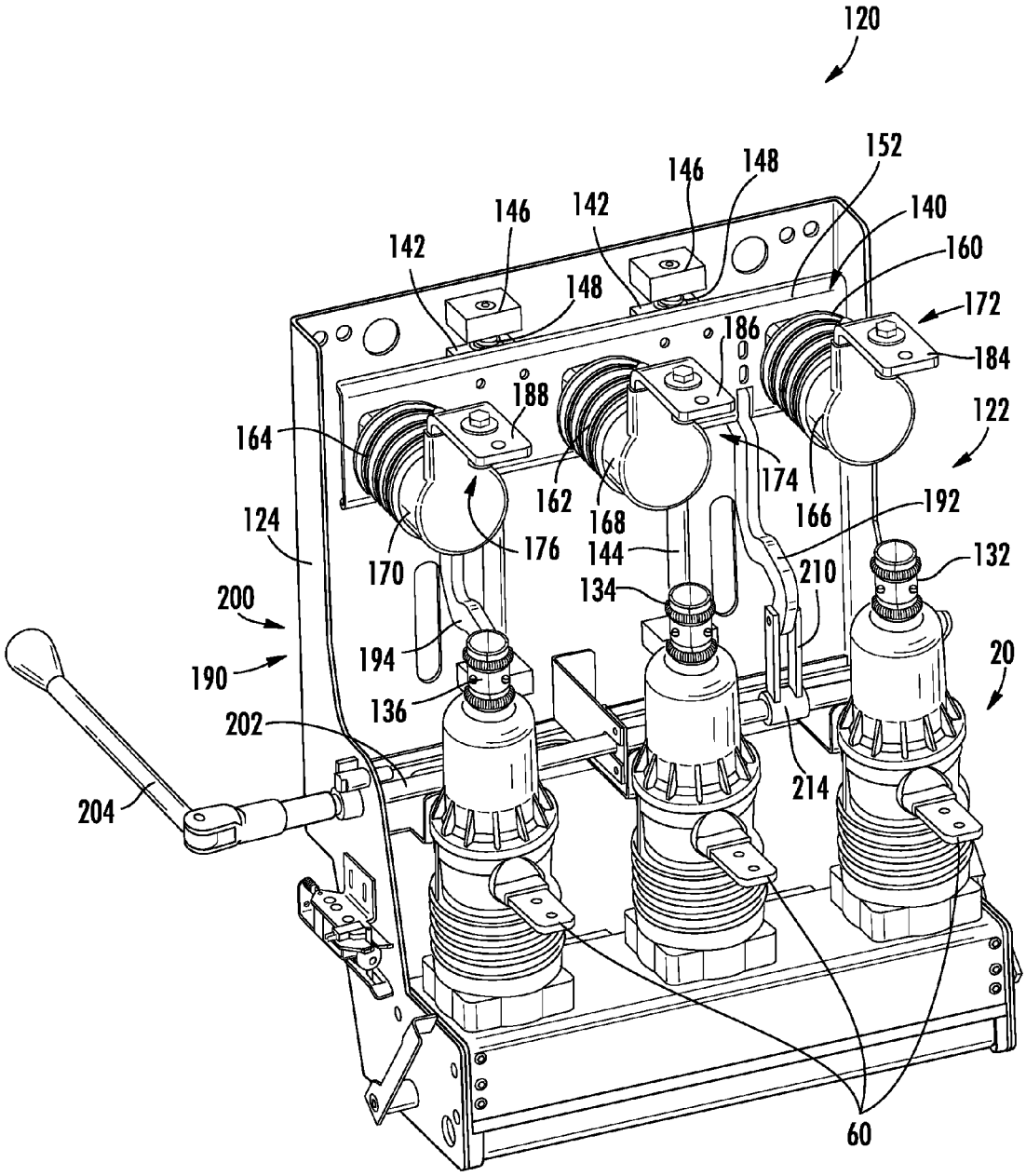
FIG. 4 is a three-dimensional view generally from the front of the switchgear embodying the invention in its first configuration or state.
Figure 5:
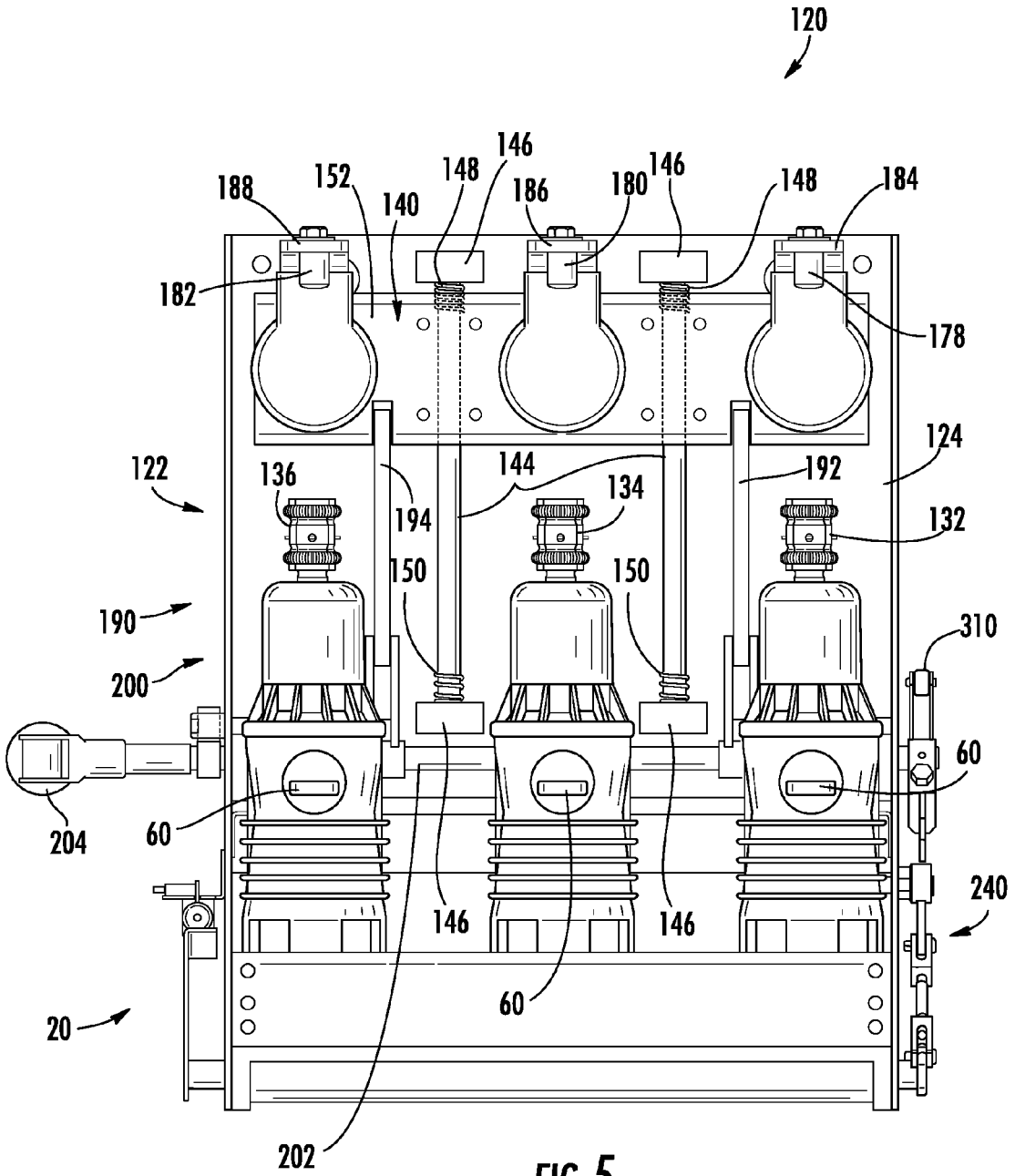
FIG. 5 is a front elevational view of the switchgear embodying the invention in its first configuration or state.
Figure 6:
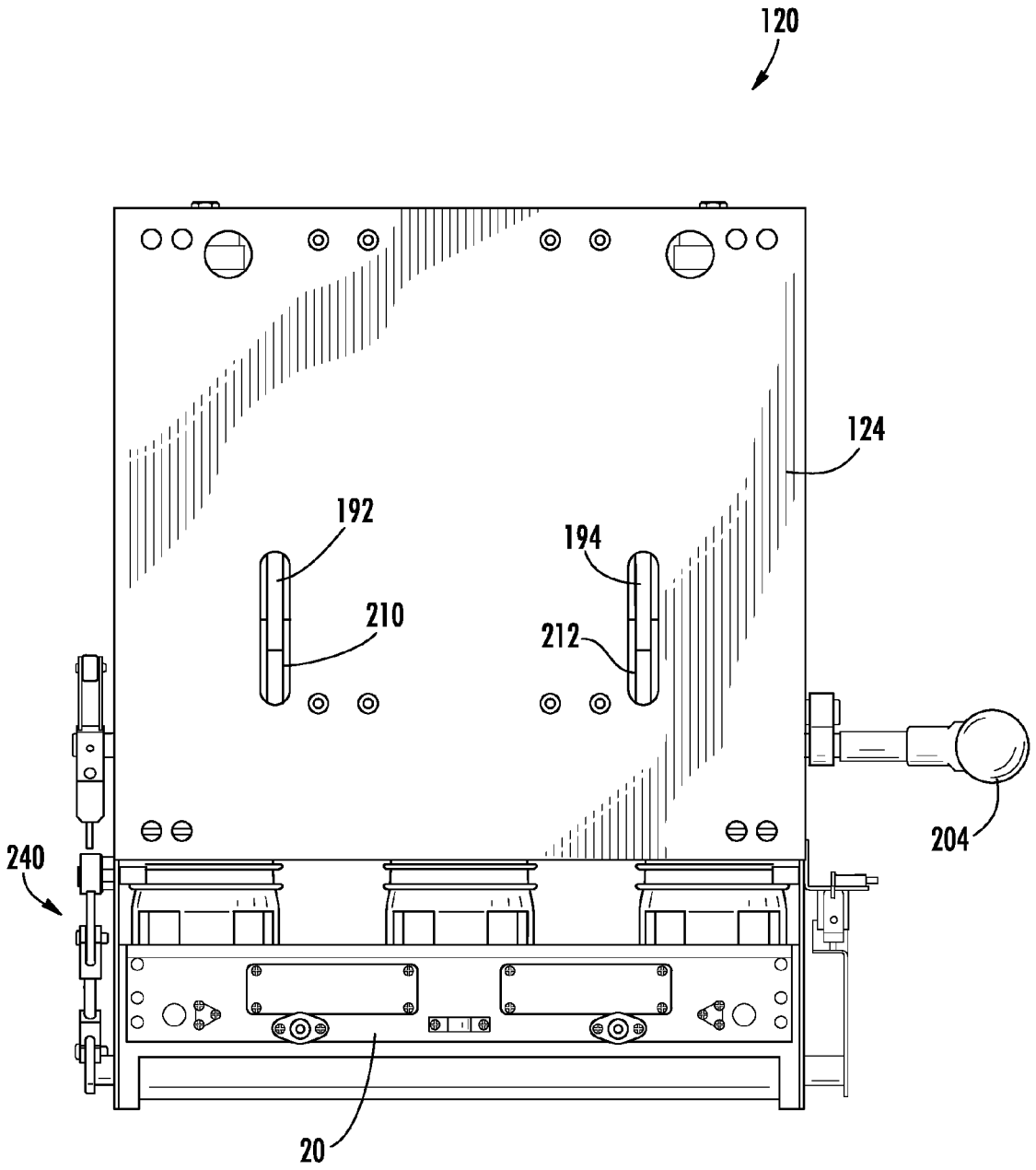
FIG. 6 is a rear elevational view of the switchgear embodying the invention in its first configuration or state.

Also visible in FIGS. 1A and 1B is a general purpose insulated mount 64 secured to the outside of the outer insulating tower 32, and electrically insulated from the internal high voltage components. As an example, the insulated mount 64 may be employed to mechanically secure conventional barriers (not shown) between the phase modules 26 and 28, and between the phase modules 28 and 30.

Generally within the base 24, the circuit breaker module 20 includes an electrically-activated magnetic actuator 70 connected via a drive insulator 72 to drive the conductive rod 50 for closing and opening the circuit breaker contacts 36 and 38.

As described in greater detail hereinbelow, the magnetic actuator 70 is stable, without requiring electric current flow through the magnetic actuator 70, either in a breaker-closed state (in which the conductive rod 50 and movable lower circuit breaker contact 38 are driven upward), or in a breaker-open state (the configuration of FIG. 1A) in which the conductive rod 50 and the movable lower circuit breaker contact 38 are retracted downwardly.

The magnetic actuator 70 includes, near the upper end of the magnetic actuator 70, an annular magnetic stator 74; near the lower end of the magnetic actuator 70, a movable annular magnetic armature 76 which moves relative to the stator 74; and a coil 78 which is energized with electrical current to activate the magnetic actuator 70. The magnetic actuator 70 additionally includes a compression spring 80 mechanically connected so as to urge the armature 76 down and away from the magnetic stator 74.

An actuator rod 82 is connected to be driven by the magnetic armature 76 and passes upwardly through a central passageway in the magnetic actuator 70. At its upper end the actuator rod 82 is connected to the lower end of the drive insulator 72.

Accordingly, when an energizing current is driven through the coil 78 in a manner directing the breaker contacts 36 and 38 to close, the magnetic armature 76 moves upwardly to physically contact the magnetic stator 74, driving the actuator rod 82, drive insulator 72, conductive rod 50 and movable lower circuit breaker contact 38 upwardly. When current is driven through the coil 78 in a manner directing the circuit breaker contacts 36 and 38 to open, the magnetic armature 76, urged by the compression spring 80, moves downwardly, away from the magnetic stator 74, pulling down on the drive insulator 72, and thus the conductive rod 50 and lower circuit breaker contact 38.

An important characteristic of the magnetic actuator 70 is that a portion of the magnetic stator 74 is made of high-coercivity material. In other words, and stated more generally, during operation, at least one of the magnetic stator 74 and the magnetic armature 76 has characteristics of a permanent magnet, maintaining residual magnetism, such that, in the breaker-closed state, the stator 74 and armature 76 are magnetically held tightly together, against the force of the compression spring 80, and without requiring any ongoing energization of the coil 78 to hold or maintain the closed state. Accordingly, the armature 76 is magnetically latched to the stator 74, holding the circuit breaker contacts 36 and 38 closed.

During operation, the control module 22 drives current through the coil 78 so as to close and open the circuit breaker contacts 36 and 38. More particularly, to close the circuit breaker contacts 36 and 38, the control module 22 drives a current pulse of one polarity through the coil 78, causing the magnetic armature 76 to move upward against the stator 74, to be held by residual magnetism. When the circuit breaker contacts 36 and 38 are to open (trip), the control module 22 drives a current pulse of opposite polarity through the coil 78, which demagnetizes the stator 74 and armature 76, so that the armature 76 moves downward and away from the stator 74, urged by the compression spring 80.

Thus, fundamentally the magnetic actuator 70 and therefore the phase module 26 are electrically-activated by current pulses from the control module 22 to either close or open (trip) the circuit breaker contacts 36 and 38. However, the circuit breaker contacts 36 and 38 also can be mechanically opened, without requiring a current pulse through the coil 78.

More particularly, an externally-connectable mechanical drive, generally designated 84, is provided. The externally-connectable mechanical drive 84 can destabilize the breaker-closed state to open the circuit breaker contacts 36 and 38. The residual magnetic characteristics of the stator 74 and armature 76 are such that the stator 74 and armature 76 are held tightly together so long as there is no gap in between them. With sufficient external force, the armature 76 can be pulled down away from the stator 74, breaking the magnetic latch.

In the particular embodiment described in detail herein, the externally-connectable mechanical drive 84 takes the form of a shaft 90, which in a three-phase breaker also functions as and may be termed a synchronizing shaft 90, which engages a mechanical coupling structure 92 (detailed in FIGS. 1C and 1D) secured to the underside of the movable armature 76, as part of a mechanism to convert linear up and down motion of the armature 76 to rotational motion of the synchronizing shaft 90, and vice versa. The mechanical coupling structure 92, which functions as a notched rod, cooperates with a slotted tooth 94 fixed to the shaft 90 or synchronizing shaft 90. The slotted tooth 94, which resembles a cam, has a plurality of individual tooth sections 96 which engage corresponding openings 98 in the mechanical coupling structure 92, the openings 98 being separated by ribs 100. Accordingly, external rotation of the synchronizing shaft 90 (counterclockwise in the orientation of FIGS. 1A, 1B, 1C and 1D), and thus of the slotted tooth 94, pulls the coupling structure 92 downward, and the magnetic armature 76 away from the stator 74, thereby breaking the magnetic latching effect, destabilizing the breaker-closed state, so that the circuit breaker contacts 36 and 38 open.

Conversely, during normal operation of the circuit breaker module 20, when the coil 78 is driven by the control module 22, up and down motion of the magnetic armature 76 is transmitted via the coupling structure 92 and the slotted tooth 94 to rotate the synchronizing shaft (or, more generally, to move the externally-connectable mechanical drive 84) in one direction or another between a breaker-closed and a breaker-open position as the magnetic actuator 70 opens and closes the circuit breaker contacts 36 and 38. This movement of the externally-connectable mechanical drive 84 (rotation of the synchronizing shaft 90 in the disclosed embodiment) can be employed to mechanically drive external elements, for example, for the purpose of indicating the state of the circuit breaker module 20, in other words, whether the contacts 36 and 38 are open or closed. In addition, in order to mechanically and positively prevent closure of the circuit breaker contacts 36 and 38 notwithstanding energization of the coil 78, movement of the mechanical drive 84 can externally be blocked. In the illustrated embodiment, an end 104 of the synchronizing shaft 90 has a slot 106 extending diametrically across the end 104 to facilitate positive mechanical engagement with the synchronizing shaft 90.

In the illustrated embodiment where there are three-phase modules 26, 28 and 30, another one of the functions of the synchronizing shaft 90 is to ensure that the circuit breaker contacts of all three-phase modules 26, 28 and 30 open and close together. For this purpose, external mechanical connections to the synchronizing shaft 90, either to drive the synchronizing shaft 90 or to be driven by the synchronizing shaft 90, are not relevant.

Alternatively, the externally-connectable mechanical drive 84 may take the form of a push pin 108 or interlocking pin 108 which is part of the circuit breaker module 20, and is linked to the synchronizing shaft 90. (Two push pins or interlocking pins are provided, but they are essentially identical, and only push pin 108 is described in detail herein.) To convert rotational motion to the synchronizing shaft 90 to linear in-and-out motion of the push pin 108, a radially-extending pin 110 is fixed to the synchronizing shaft 90, and the pin 110 engages an aperture 112 in the push pin 108. The aperture 112 is slightly elongated.

Accordingly, externally pushing in the push pin 108 causes the synchronizing shaft 90 to rotate, in turn pulling the magnetic armature 76 down away from the stator 74 to open the circuit breaker contacts 36 and 38. Conversely, during normal operation of the circuit breaker module 20, up and down motion of the armature 76 as the coil 78 is energized is converted to rotation of the synchronizing shaft 90, which drives out and in motion of the push pin 108. Although not illustrated, external mechanical connections, described in greater detail hereinbelow, may be made to the push pin 108 rather than to the end 104 of the synchronizing shaft 90.

Referring now to FIGS. 2-8, switchgear 120 embodying the invention is shown in a first configuration or state.

The switchgear 120 includes a visible disconnect switch, generally designated 122, as well as the circuit breaker or interrupter module 20 which includes the actual vacuum interrupter 34. The circuit breaker or interrupter module 20 and visible disconnect switch 122 are mounted to a fixed frame 124.

The circuit breaker or interrupter module 20 included as part of the switchgear 120 is as described hereinabove with reference to FIGS. 1A, 1B, 1C and 1D.

The insulating towers 32 of the circuit breaker or interrupter module 20 are generally cylindrical in configuration, defining respective longitudinal axes 126, 128 and 130, and each has a top defined by the upper terminal structure 44. The longitudinal axes 126, 128 and 130 are parallel to each other and in a common plane. Attached and electrically connected to each upper terminal structure 44 is a fixed disconnect switch contact 132, 134 or 136.

As part of the visible disconnect switch 122, the switchgear 120 includes a carriage 140, which can move or translate up and down in the orientation of the drawing FIGURES on linear bearings 142 (FIGS. 4 and 7) along cylindrical rails 144 supported by mounts 146 secured to the frame 124. To facilitate "over center" locking in the switch-open and switch-closed positions as described in greater detail hereinbelow, upper compression springs 148 and lower compression springs 150 are located immediately adjacent the mounts 146, and are engaged by the linear bearings 142 at the upper and lower limits of carriage 140 travel. More particularly, the carriage 140 can move or translate in a direction parallel to the longitudinal axes 126, 128 and 130 of the insulating towers 32, and parallel to the plane in which the axes 126, 128 and 130 lie. In addition to the linear bearings 142, the carriage 140 includes a base plate 152 to which the linear bearings 142 are secured, and in essence the carriage 140 is supported by the linear bearings 142.

Secured to the carriage 140 are three insulators 160, 162 and 164 having respective distal ends 166, 168, and 170. Attached to and supported by the distal ends 166, 168 and 170 are respective terminal/contact structures 172, 174 and 176, each comprising a movable disconnect switch contact 178, 180 or 182, and a terminal 184, 186 or 188. The terminals 184, 186 and 188 serve as either input or output terminals of the switchgear 120 depending on the particular application. Correspondingly, the side terminals 60 of the phase modules 26, 28 and 30 serve as either output or input terminals of the switchgear 120, again depending on the particular application. Flexible power conductors (not shown) are connected to the terminals 184, 186 and 188, respectively. The flexible power conductors may be connected either to a power source, or to a load.

The fixed disconnect switch contacts 132, 134 and 136 and the movable disconnect switch contacts 178, 180 and 182 are significant elements of the visible disconnect switch 122. Significantly, the open (FIGS. 2-8) or closed (FIGS. 9-12 and FIGS. 13 and 14) configuration or state of the visible disconnect switch 122, and more particularly the configuration or state (whether opened or closed) of the contact pairs 132, 178; 134, 180; and 136, 182, is readily observable.

In the first configuration or state of the switchgear 120 as illustrated in FIGS. 2-8, the visible disconnect switch 122 and the circuit breaker or interrupter module 20 are both open. The open state of the visible disconnect switch 122 is clearly evident by observing the contact pairs 132, 178; 134, 180; and 136, 182. Although internal components of the circuit breaker phase modules 26, 28 and 30 are not visible, the open state of the circuit breaker module 20 can be determined by the rotational position of the end 104 of the synchronizing shaft 90. More particularly, the rotational position of the synchronizing shaft 90 is indicated by the position of a synchronizing shaft lever arm 280 (FIGS. 2 and 3) fixedly connected to the end 105 of the synchronizing shaft, employing the slot 106 for positive location.

Figure 9:
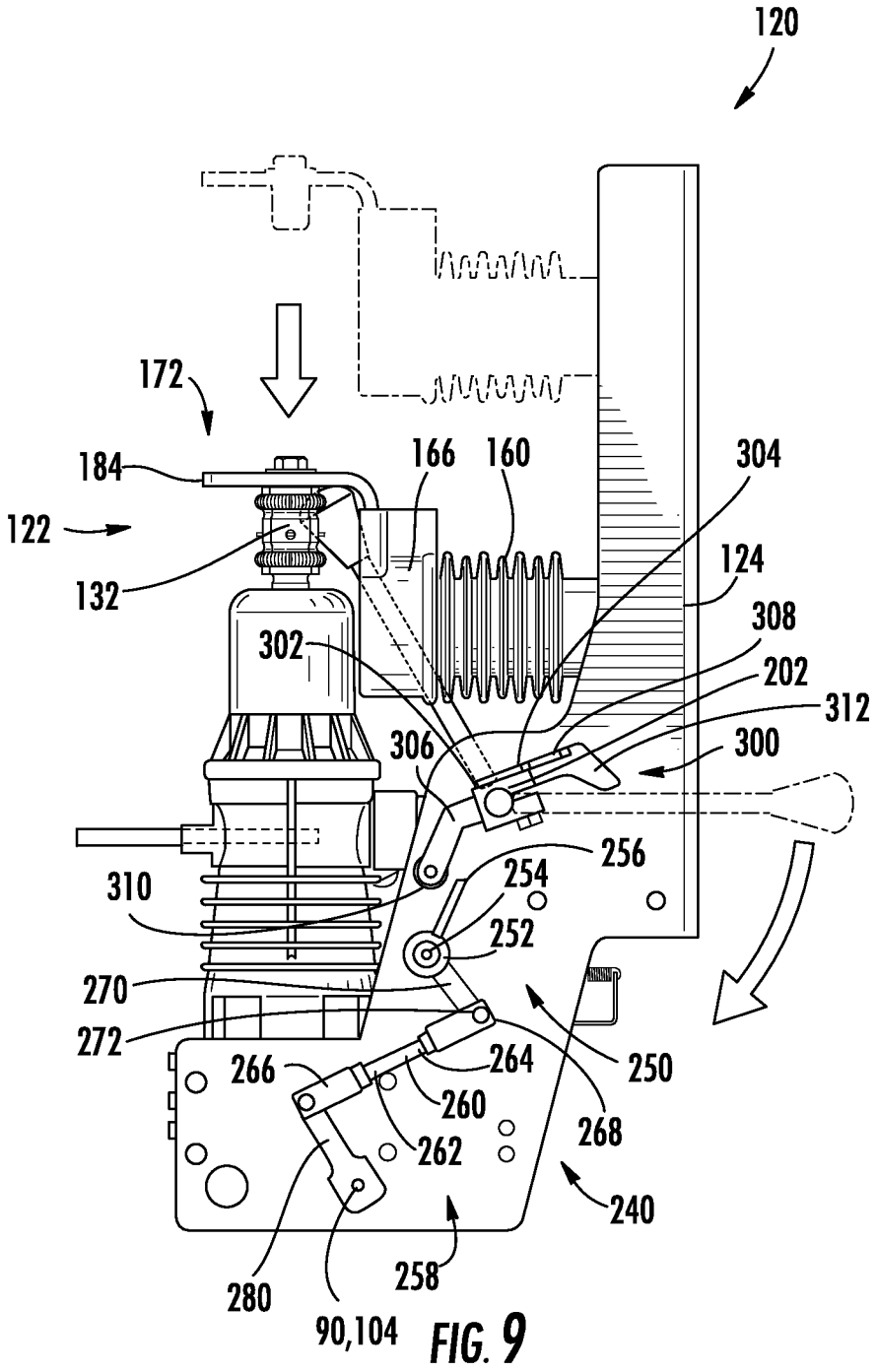
FIG. 9 is a right side elevational view of the switchgear embodying the invention, in the same orientation as FIG. 3, but in a second configuration or state wherein the disconnect switch and the interrupter are both closed.
Figure 10:
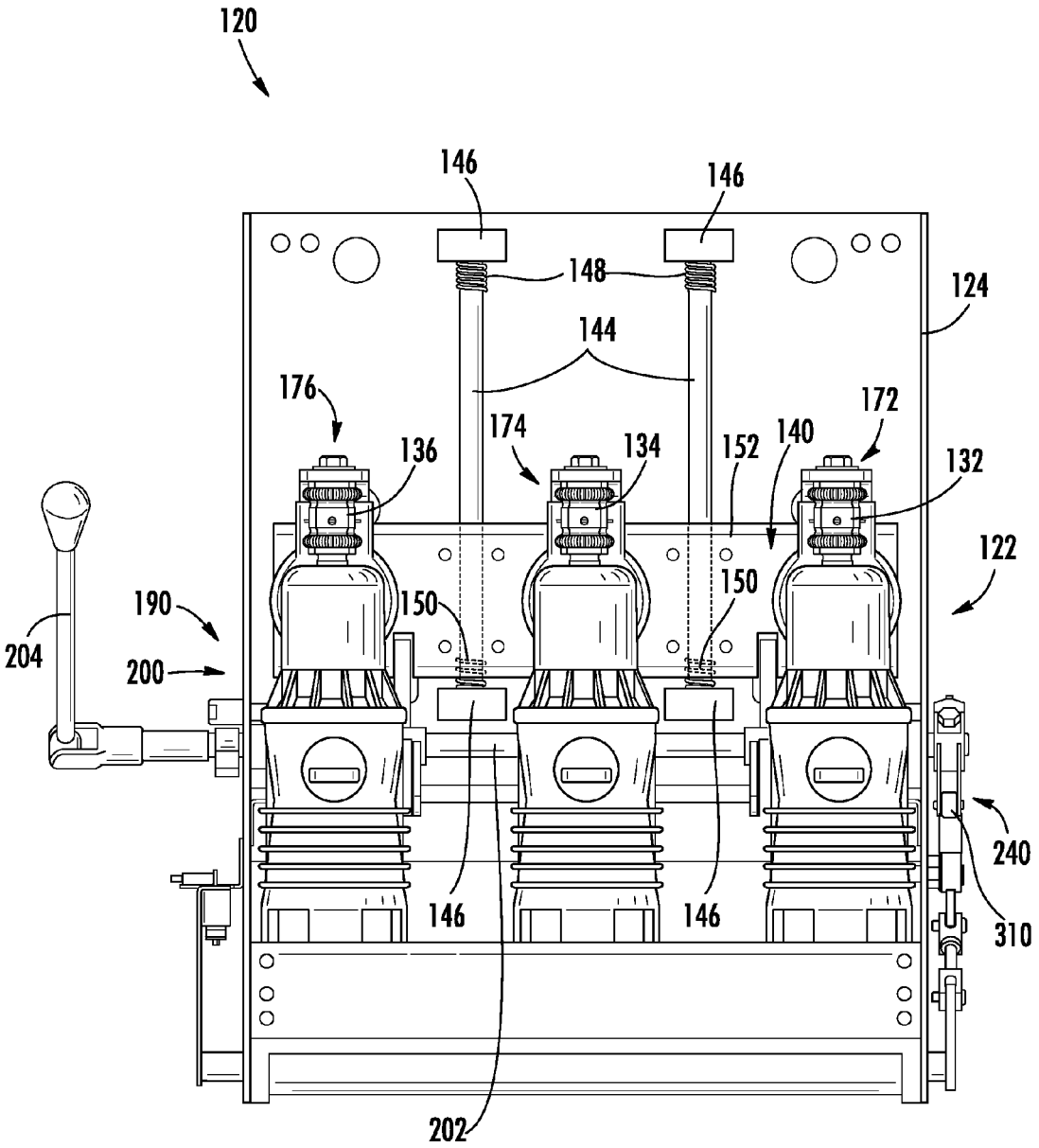
FIG. 10 is a front elevational view, in the same orientation as FIG. 6, but with the switchgear embodying the invention in its second configuration or state.

FIGS. 9-12 correspondingly illustrate the switchgear 120 in a second configuration or state, in which the disconnect switch 122 and the circuit breaker or interrupter module 20 are both closed. The closed state of the visible disconnect switch 122 is clearly evident by observing the contact pairs 132, 178; 134, 180; and 136, 182. Again, although internal components of the circuit breaker phase modules 26, 28 and 30 are not visible, the closed state of the circuit breaker or interrupter module 20 can be determined by the rotational position of the synchronizing shaft 90, and more particularly by the position of the synchronizing shaft lever arm 280 (FIG. 9).

Figure 12:
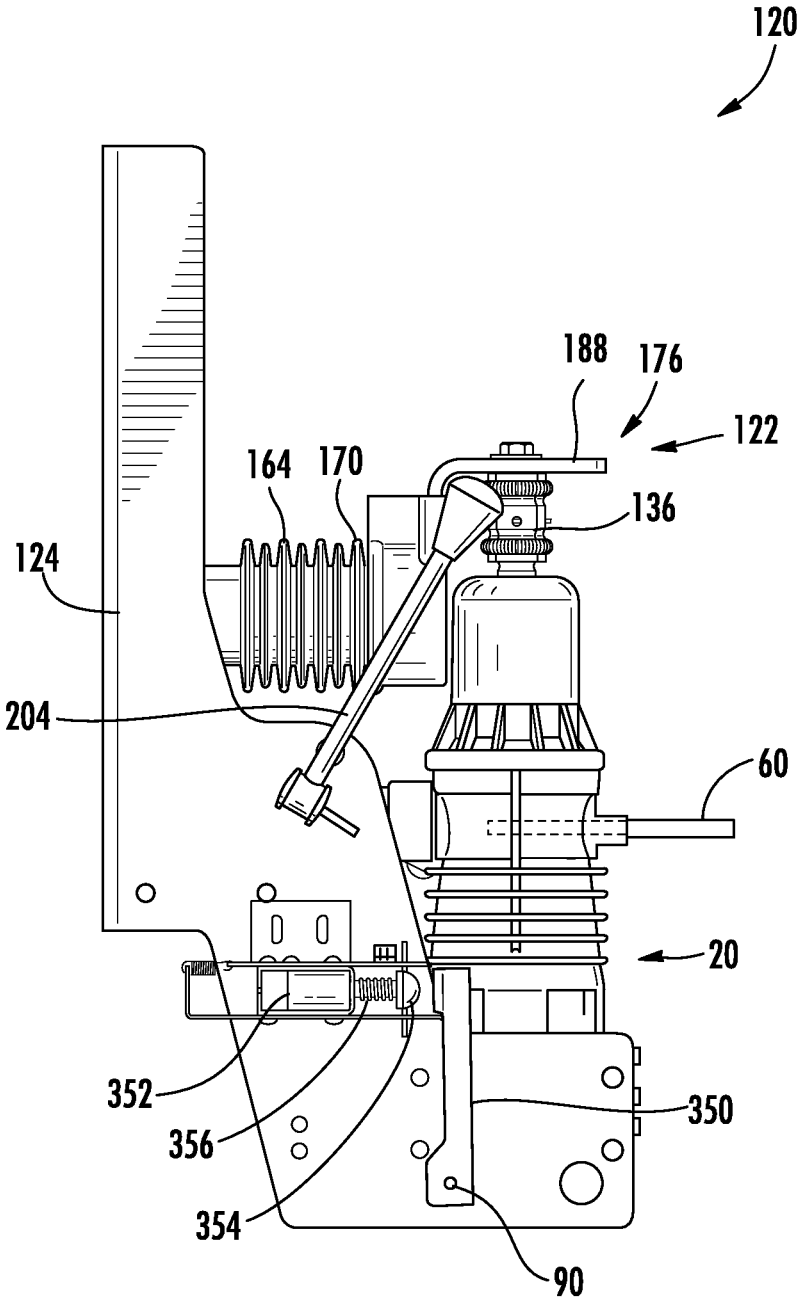
FIG. 12 is a left side elevational view of the switchgear embodying the invention, in the same orientation as FIG. 8, but in the second configuration or state.
Figure 13:
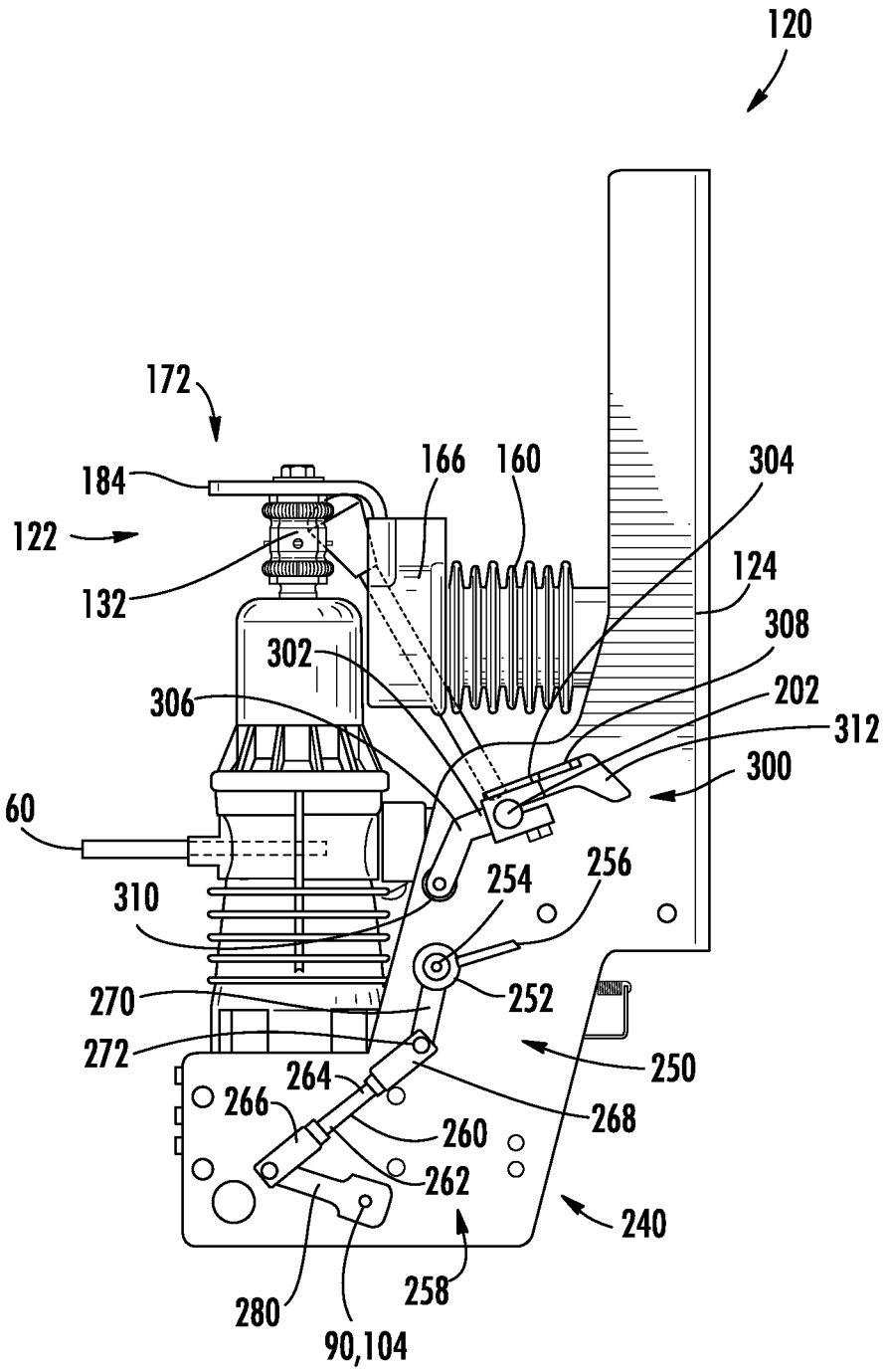
FIG. 13 is a right side elevational view of the switchgear embodying the invention, in the same orientation as FIGS. 3 and 9, but in a third configuration or state wherein the disconnect switch is closed, but the interrupter is open.
Figure 14:
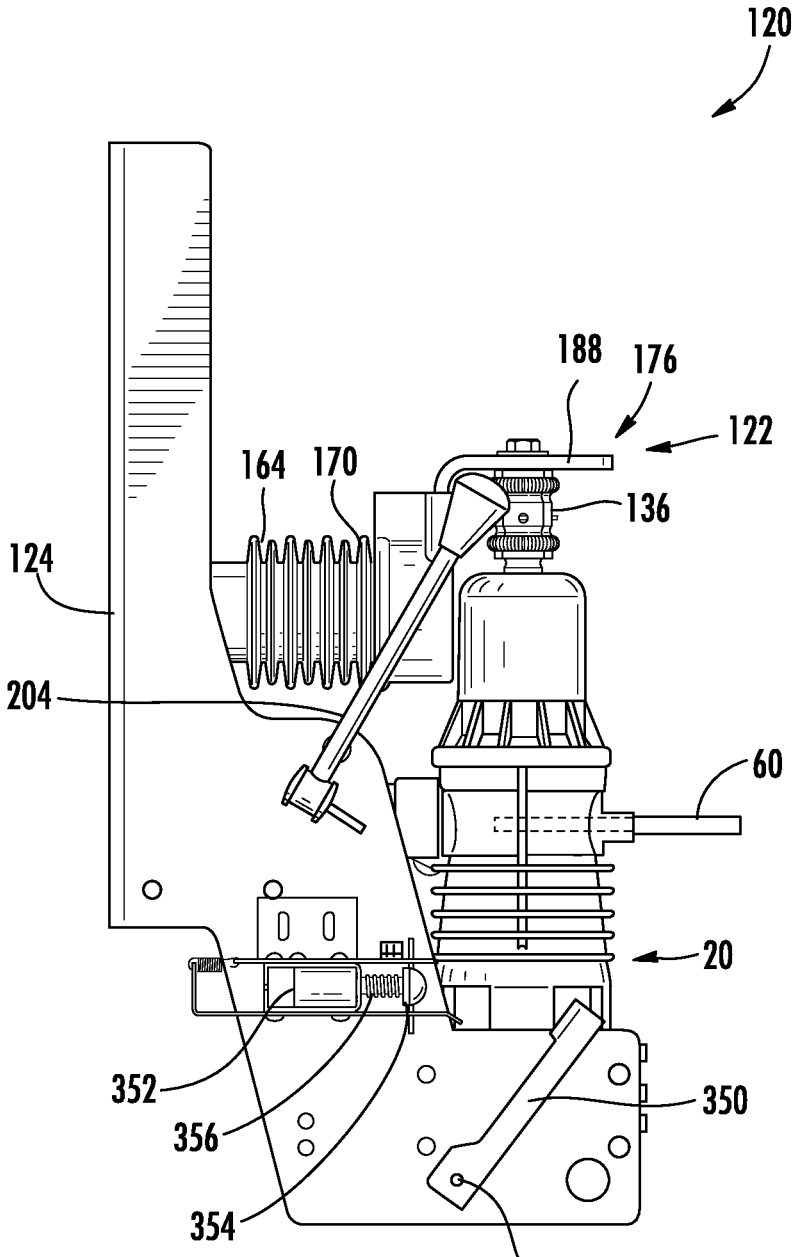
FIG. 14 is a left side elevational view of the switchgear embodying the invention, in the same orientation as FIGS. 8 and 12, but with the switchgear in the third configuration or state.

FIGS. 13 and 14 illustrate the switchgear 120 in a third configuration or state, in which the disconnect switch 122 is closed, but the circuit breaker or interrupter module 20 is open, awaiting activation of the magnetic actuator 70. This configuration or state is recognized by the closed state of the contact pairs 132, 178; 134, 180; and 136, 182 of the visible disconnect switch 122 (as in the second state of FIGS. 9-12), and the position of the synchronizing shaft 90 of the circuit breaker module 20 (as in the first state of FIGS. 2-8), and more particularly by the position of the synchronizing shaft lever arm 280 (FIG. 13).

Figure 15:
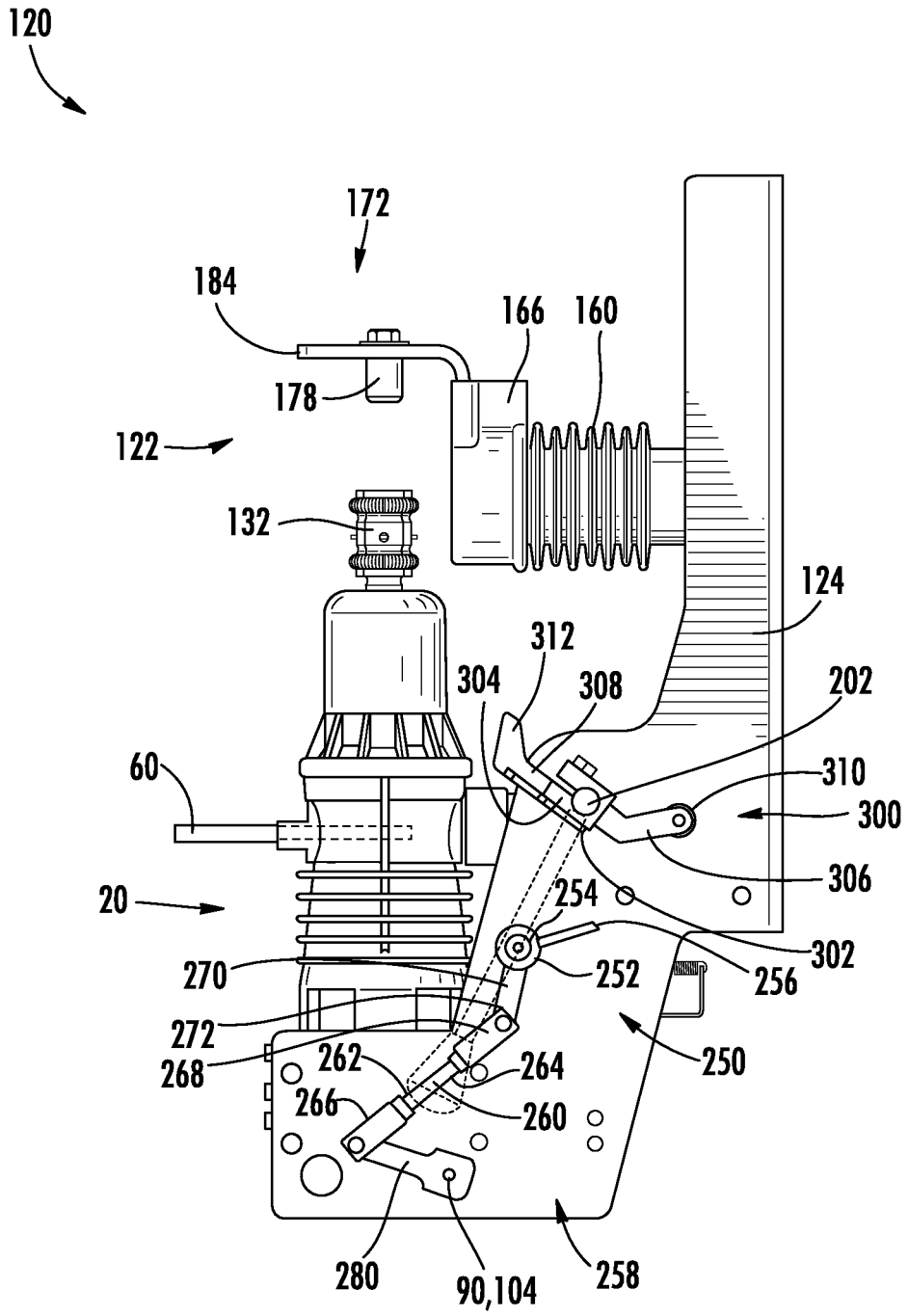
FIG. 15 is a right side elevational view of the switchgear embodying the invention, in the same orientation as FIGS. 3, 9 and 13, but with the switchgear in an intermediate transitory configuration or state.
Figure 16:
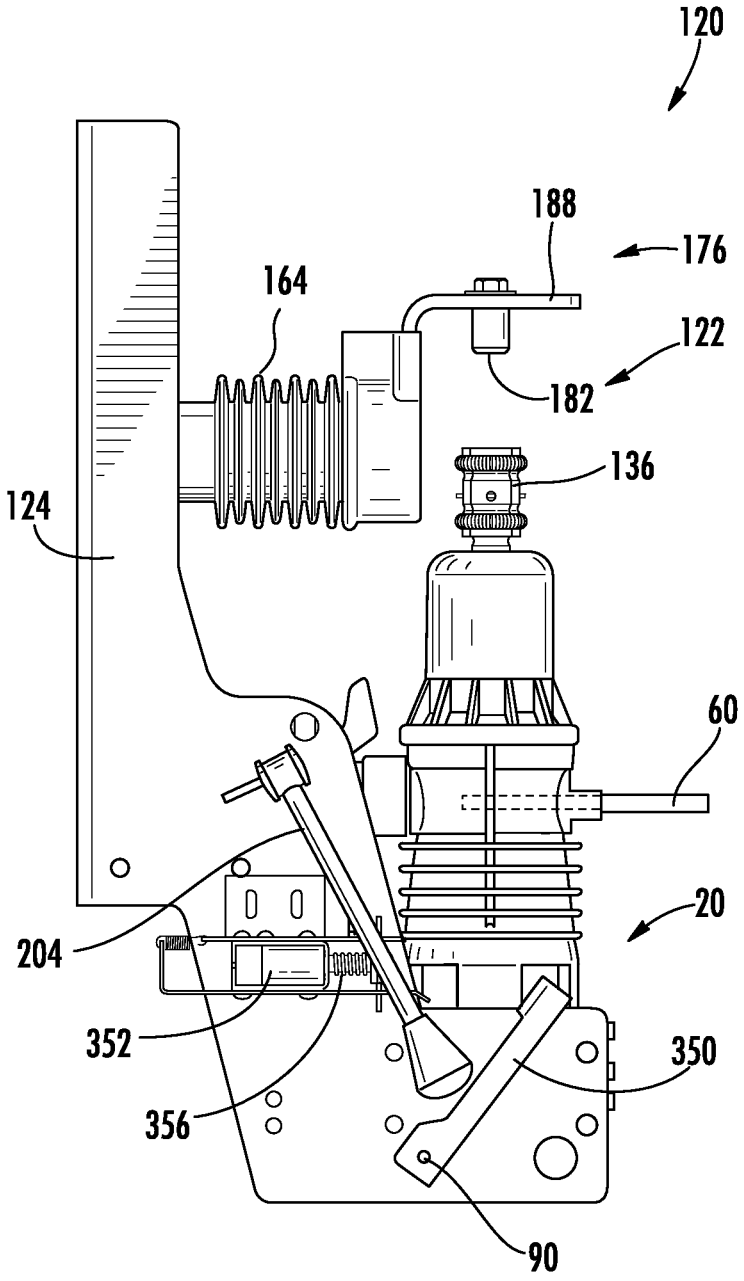
FIG. 16 is a left side elevational view of the switchgear embodying the invention, in the same orientation as FIGS. 8, 12 and 14, but with the switchgear in the intermediate transitory configuration or state.

FIGS. 15 and 16 illustrates the switchgear 120 in an intermediate transitory state or configuration, between the second configuration or state of FIGS. 9-12 or the third configuration or state of FIGS. 13 and 14, and the first configuration or state of FIGS. 2-8, as the visible disconnect switch 122 is either being opened (second state or third state to first state) or closed (first state to third state).

During typical operation, during which a load (not shown) is energized and de-energized through operation of the circuit breaker module 20, the switchgear 120 is in the second configuration or state of FIGS. 9-12, or the third configuration or state of FIGS. 13 and 14. Thus, typically the visible disconnect switch 122 remains closed, while the circuit breaker module 20 controls energization of the load.

For moving the carriage 140 between its disconnect switch 122 open position (the first state or configuration of FIGS. 2-8) and its disconnect switch 122 closed position (both the second state or configuration of FIGS. 9-12, and the third state or configuration of FIGS. 13 and 14), and thereby operating the visible disconnect switch 122, a switch actuator, generally designated 190 is provided. In the illustrated embodiment, the switch actuator 190 takes the form of a pair of push rods 192 and 194 or links 192 and 194.

For operating the switch actuator 190, a main switch actuator 200 is in turn provided. In the illustrated embodiment, the main switch actuator 200 includes a main actuator shaft 202. The main actuator shaft 202 is rotatable through an angular range of approximately 240° between a switch-open position (first configuration or state of FIGS. 2-8); and a switch-closed position (second configuration or state of FIGS. 9-12 and third configuration or state of FIGS. 13 and 14). In the illustrated embodiment, the main actuator shaft 202 and thus the visible disconnect switch 122 is manually-operated by a handle 204. The handle 204 is exemplary only. Other mechanisms (not shown) may be employed to rotate the main actuator shaft 202 and accordingly operate the visible disconnect switch 122. For example, a motor (not shown) may be employed.

At their lower ends, the push rods 192 and 194 are connected to and moved by corresponding yoke arms 210 and 212 welded to and extending from respective cylindrical yoke hubs 214 and 216, which hubs 214 and 216 are in turn keyed to the main actuator shaft 202.

In order for the switch-open (FIGS. 2-8); and switch-closed (FIGS. 9-12) and (FIGS. 13 and 14) positions to be locked "over center," as noted above the handle 204 and main actuator shaft 202 rotate through an angular range of approximately 240° rather than merely 180°. The upper compression springs 148 and the lower compression springs 150 selectively are compressed as the handle 204 and main actuator shaft 202 reach either limit of their rotation. In the switch-closed position, the pushrods 192 and 194 nest onto the yoke hubs 214 and 214, and are inclined to stay there because the lower compression springs 150 are compressed. Similarly, in the switch-open position, the yoke arms 210 and 212 are rotated upwardly slightly over center, and the upper compression springs 148 are compressed. The shaft 202 and yoke arms 210 and 212 again are inclined to stay in that position. In addition, when moving to either the switch-open or switch-closed position, friction of the linear bearing 142 encourages a slow and deliberate movement between positions.

A mechanical interlock, generally designated 240, is provided, interconnecting the circuit breaker module 20 and the visible disconnect switch 122. In addition, an electrical interlock (not shown) may be provided. Among other functions, the mechanical 240 and electrical interlocks ensure that switching under load, in particular current interruption, is always provided by the circuit breaker or interrupter module 20, and never by the contacts 132, 178; 134, 180; and 136, 182 of the visible disconnect switch 122.

The mechanical interlock 240 more particularly takes the form of a mechanism 240 driven by the main actuator shaft 202, and, among other aspects, is connected so as to force movement of the externally-connectable mechanical drive 84 of the circuit breaker module 20 so as to cause the circuit breaker contacts, for example the contacts 36 and 38, to open as the main switch actuator 200 begins to move from its switch-closed position (FIGS. 9-12), which is the second configuration or state, to its switch-open position (FIGS. 2-8), which is the first configuration or state.

The mechanical interlock mechanism 240 includes a trip lever assembly 250 including a bearing-supported hub 252 freely rotatable on a bearing 254, and a trip lever 256 extending radially from the bearing-supported hub 252. A linkage, generally designated 258, transfers rotation of the bearing-supported hub 252 to rotation of the synchronizing shaft 90 of the circuit breaker module 20, and vice versa. The linkage 258 more particularly includes an adjustable-length connecting link 260 having first and second ends 262 and 264, with a respective clevis 266 and 268 at each end. Also fixably attached to the bearing-supported hub 252 is a connecting lever arm 270, connected near its distal end 272 to the clevis 268 at the second end 264 of the connecting link 260.

The clevis 266 at the first end 262 of the connecting link 260 is pivotably connected to a synchronizing shaft lever arm 280 fixedly connected to the end 104 of the synchronizing shaft 90, and keyed employing the slot 106 for positive location.

A tripping and mechanical interlock assembly, generally designated 300, is driven by the main actuator shaft 202 and engages the trip lever assembly 250, and in particular the trip lever 256 thereof. The tripping and mechanical interlock assembly 300 includes a pair of hub-like bases 302 and 304 secured to an end of the main actuator shaft 202 (opposite the end of the main actuator shaft 202 to which the handle 204 may be connected). Extending generally in diametrically opposite directions are a radially-extending yoke 306 fixed to the hub-like base 302, and a radially-extending stop arm 308 fixed to the hub-like base 304. A roller 310 is supported on a bearing at the end of the yoke 306, and a mechanical stop 312 is at the end of the radially-extending stop arm 308.

Figure 7:
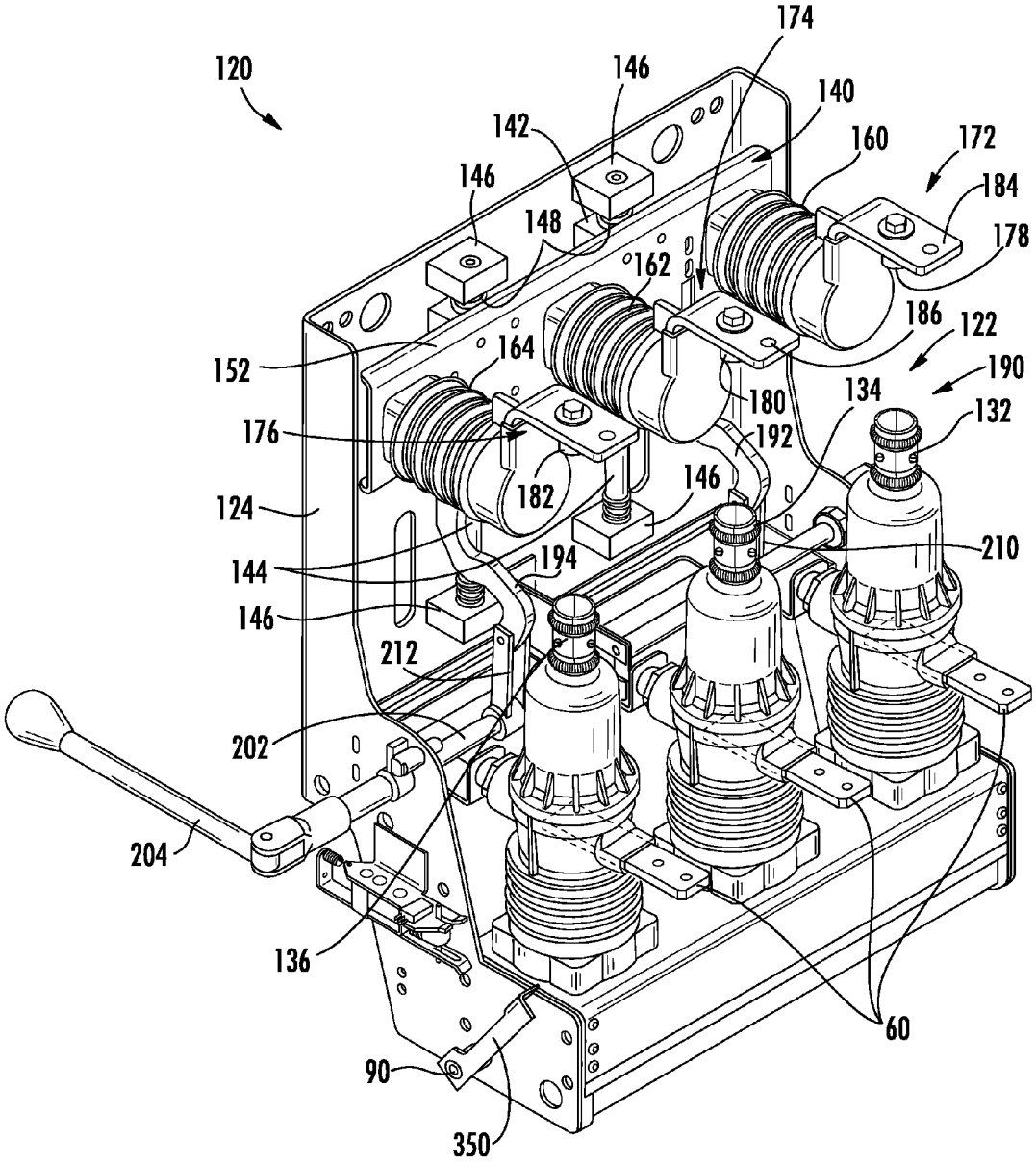
FIG. 7 is a three-dimensional view generally from the left side of the switchgear embodying the invention in its first configuration or state.
Figure 8:
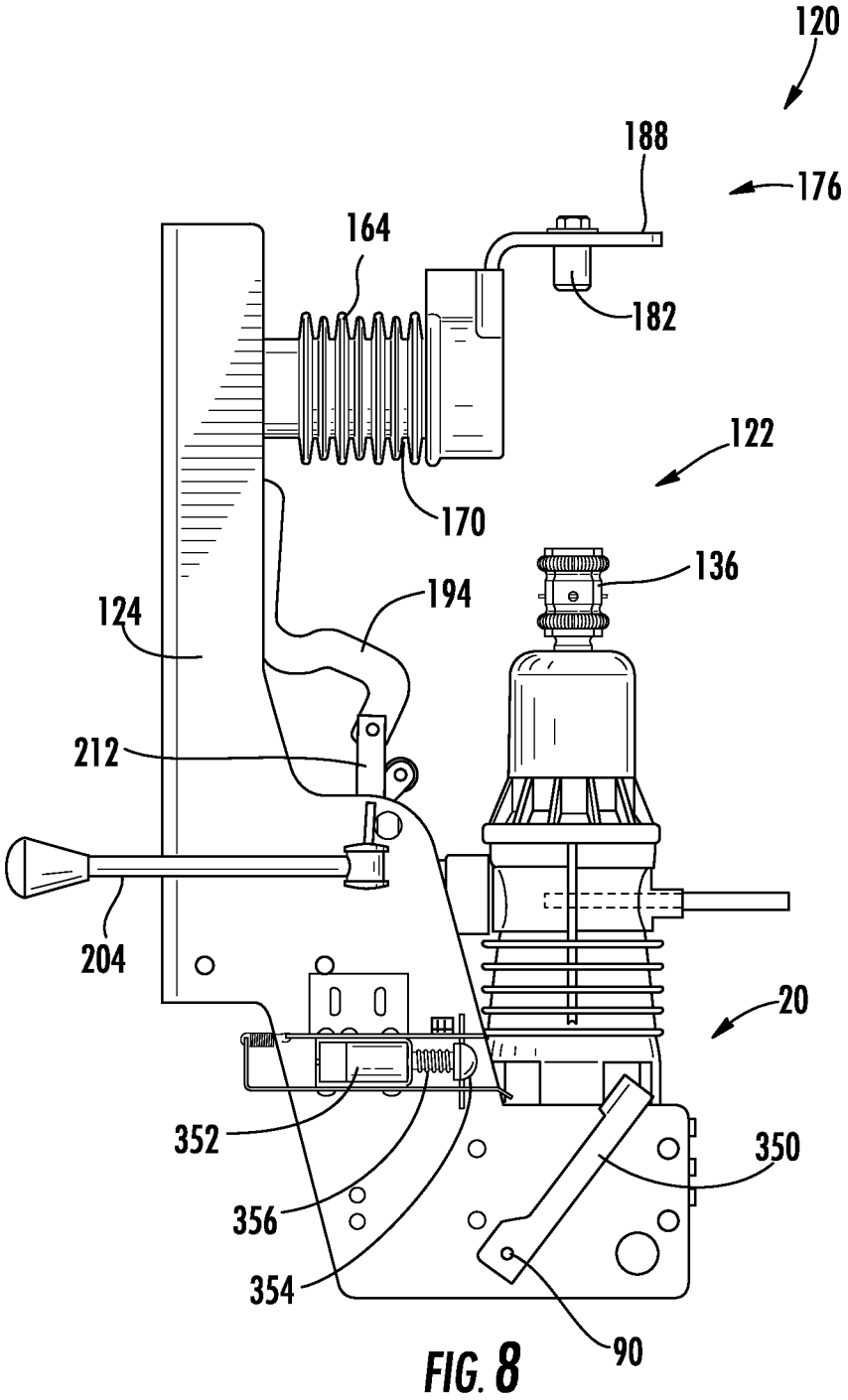
FIG. 8 is an elevational view from the left side of the switchgear embodying the invention in its first configuration or state.

In the first configuration or state of the switchgear 120 as illustrated in FIGS. 2-8, the handle 204 is rotated clockwise to the rear when viewed from the right side as in FIGS. 7 and 8, thus rotating the main actuator shaft 202. The push rods 192 and 194 are driven upwardly by the yoke arms 210 and 212, accordingly moving the carriage 140 to its fully upward position, and opening the visible disconnect switch 122 with the contact pairs 132, 178; 134, 180; and 136, 182 clearly open. The radially-extending stop arm 308 is rotated to a down position. More particularly, the stop 312 is immediately adjacent the trip lever 256 of the trip lever assembly 250, providing a positive mechanical interlock against attempted closing of the circuit breaker or interrupter module 20. Although electrical interlocks should prevent any such attempted actuation when the visible disconnect switch 122 is open, even if the magnetic actuator 70 were energized in an attempt to close the circuit breaker or interrupter module 20, rotation of the synchronizing shaft 90 would positively be prevented by the linkage 258 connected to the lever arm 270.

In the second configuration or state illustrated in FIGS. 9-12, the handle 204 is rotated counterclockwise approximately 240° with reference to the first configuration or state, to an upward front position when viewed from the right side as in FIG. 12, thus rotating the main actuator shaft 202. The yoke arms 210 and 212 are directed downwardly, moving the push rods 192 and 194 and the carriage 140 to their full down positions. The visible disconnect switch 122 is closed, as is visibly observable from the mating contact pairs 132, 178; 134, 180; and 136, 182. The radially-extending stop arm 308 is rotated upwardly so that the stop 312 is out of the way. At the same time, the radially-extending yoke 306 and roller 310 are rotated to a generally down position. The circuit breaker or interrupter module 20 is closed, with the connecting lever arm 270 moved approximately 45° clockwise with reference to the first configuration or state, and the bearing-supported hub 252 and attached trip lever 256 rotated approximately 45° counterclockwise so that the trip lever 256 rests either in contact with or immediately adjacent the roller 310 of the tripping and mechanical interlock assembly 300.

With the visible disconnect switch 122 closed and the radially-extending yoke 306 and roller 310 of the tripping and mechanical interlock assembly 300 oriented generally downwardly as in the second configuration or state of FIGS. 9-12, and in the third configuration or state as in FIGS. 13 and 14, the circuit breaker module 20 is free to operate, as directed by energization of the electrically-activated magnetic actuator 70, between the breaker-closed state of the second configuration or state (FIGS. 9-12) and the breaker-open state of the third configuration or state (FIGS. 13 and 14), without interference by the tripping and mechanical interlock assembly 300.

From either the second configuration or state of FIGS. 9-12 or the third configuration or state of FIGS. 13 and 14, in both cases where the visible disconnect switch 122 is closed, the visible disconnect switch 122 may be opened by operating the main switch actuator 200 via the handle 204. FIGS. 15 and 16 illustrate an intermediate or transitory state of such opening, where the main actuator shaft 202 has rotated approximately halfway through its range of rotation.

In the event the starting point is the third configuration or state of FIGS. 13 and 14 where the circuit breaker 20 is already open, and no part of the tripping and mechanical interlock assembly 300 is engaging the trip lever 256, the visible disconnect switch 122 simply opens.

In the event the starting point is the second configuration or state of FIGS. 9-12 where the circuit breaker module 20 is closed, then initial movement of the main switch actuator 200, in particular initial rotation of the main actuator shaft 202, causes the roller 310 at the end of the radially-extending yoke 306 of the tripping and mechanical interlock assembly 300 to force the trip lever assembly 250 into clockwise rotation, and, via the linkage 258, the synchronizing shaft lever arm 280 connected to the synchronizing shaft 90 of the circuit breaker or interrupter module 20 in a counterclockwise direction, mechanically forcing the vacuum circuit breaker or interrupter 34 of the circuit breaker or interrupter module 20 to open, prior to opening of the contact pairs 132, 178; 134, 180; and 136; 182 of the visible disconnect switch 122. In either case, rotation of the main actuator shaft 202 continues until the first configuration or state of FIGS. 2-8 is reached.

Alternatively, the transitory configuration or state of FIGS. 15 and 16 may be viewed as movement from the first configuration or state of FIGS. 2-8 where both the circuit breaker or interrupter module 20 and the visible disconnect switch 122 are open and the third configuration or state of FIGS. 13 and 14 where the circuit breaker or interrupter module 20 is open but the visible disconnect switch 122 is closed. As the main actuator shaft 202 rotates clockwise in the orientation of FIGS. 15 and 16, the roller 310 at the end of the radially-extending yoke 306 of the tripping and mechanical interlock assembly 300 clears the trip lever 256, until reaching the position of FIGS. 13 and 14.

Finally, to allow remote tripping of the circuit breaker module 20 when in the second configuration or state of FIGS. 9-12, on the left side of the switchgear 120 is an actuator arm 350 connected to the end of the synchronizing shaft 90 of the circuit breaker module opposite the synchronizing shaft lever arm 280. As illustrated in FIG. 12, in the second configuration or state when the circuit breaker 20 is closed, the actuator 350 is vertical. In either the first configuration or state of FIG. 8 or the third configuration or state of FIG. 14, the actuator arm 350 is rotated clockwise, when viewed from the left side orientation of FIGS. 8 and 9. As is described in greater detail in patent application Ser. No. 13/355,906, filed Jan. 23, 2012, the entire disclosure of which is hereby expressly incorporated by reference, an actuator 352 having an output rod 354 is positioned so as to remotely open the circuit breaker module 20 by causing the actuator arm 350 to rotate clockwise from its FIG. 12 vertical position. Preferably, the actuator 352 is a magnetically-latched actuator wherein the output rod 354 is movable between a reset retracted position as illustrated and magnetically held against the force of a compression spring 356, and a triggered extended position (not shown).

While a specific embodiment of the invention has been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. Switchgear comprising:

a carriage, and a switch actuator connected to said carriage for moving said carriage between a switch-closed position and a switch-open position;

a circuit breaker module including circuit breaker contacts, said circuit breaker module including first and second contactor terminals and providing selective electrical connection between said contactor terminals depending on the state of said circuit breaker contacts;

a fixed disconnect switch contact attached to or comprising one of said first and second contactor terminals;

a movable disconnect switch contact mounted to said carriage so as to move with said carriage; and said fixed disconnect switch contact and said movable disconnect switch contact being positioned for selective engagement with each other as said carriage moves to the switch-closed position.

2. The switchgear of claim 1, wherein:

said circuit breaker module includes an insulating tower generally cylindrical in configuration defining a longitudinal axis, and having a top;

said one of said first and second contactor terminals to which said fixed disconnect switch contact is attached or comprises is located at said top of said tower; and another of said first and second contactor terminals is located on a cylindrical side of said tower.

3. The switchgear of claim 2, wherein said carriage translates in a direction parallel to the longitudinal axis of said circuit breaker module.

4. The switchgear of claim 1, wherein said fixed disconnect switch contact and said movable disconnect switch contact comprise a visible disconnect switch.

5. The switchgear of claim 1, wherein:

said switch actuator comprises a link; and which further comprises a main switch actuator linked via said switch actuator to said carriage so as to open and close said fixed and movable disconnect switch contacts when moved in one direction or another between a switch-open position and a switch-closed position.

6. The switchgear of claim 1, which comprises three-phase switchgear and includes:

a three-phase circuit breaker module; and three sets of movable disconnect switch and fixed disconnect switch contacts.

7. The switchgear of claim 1 wherein:

said circuit breaker contacts are opened and closed by an electrically activated magnetic actuator which is stable in either a breaker closed state or a breaker open state without requiring electrical current flow through said magnetic actuator; and said circuit breaker module includes an externally connectable mechanical drive linked to said magnetic actuator in a manner such that movement of said externally connectable mechanical drive can destabilize the breaker closed state to open said circuit breaker contacts.

8. The switchgear of claim 7, wherein:

said switch actuator comprises a link; and which further comprises a main switch actuator linked via said switch actuator to said carriage so as to open and close said fixed and movable disconnect switch contacts when moved in one direction or another between a switch-open position and a switch-closed position.

9. The switchgear of claim 8, which further comprises a mechanical interlock mechanism driven by said main switch actuator and connected so as to force movement of said externally-connectable mechanical drive so as to cause said circuit breaker contacts to open as said main switch actuator begins to move from its switch-closed position to its switch-open position.

10. The switchgear of claim 7, which comprises three-phase switchgear and includes:

a three-phase circuit breaker module; and three sets of movable disconnect switch and fixed disconnect switch contacts.

11. Switchgear comprising:

a carriage, and a switch actuator connected to said carriage for moving said carriage between a switch-closed position and a switch-open position;

a circuit breaker module including circuit breaker contacts which are opened and closed by an electrically-activated magnetic actuator, said circuit breaker module including first and second contactor terminals and providing selective electrical connection between said contactor terminals depending on the state of said circuit breaker contacts, said magnetic actuator being stable in either a breaker-closed state or a breaker-open state without requiring electrical current flow through said magnetic actuator, and said circuit breaker module including an externally-connectable mechanical drive linked to said magnetic actuator in a manner such that movement of said externally-connectable mechanical drive can destabilize the breaker-closed state to open said circuit breaker contacts;

said circuit breaker module including an insulating tower generally cylindrical in configuration defining a longitudinal axis, and having a top;

a fixed disconnect switch contact attached to or comprising one of said first and second contactor terminals, said one of said first and second contactor terminals being located at said top of said tower;

a movable disconnect switch contact mounted to said carriage so as to move with said carriage;

another of said first and second contactor terminals being located on a cylindrical side of said tower; and said fixed disconnect switch contact and said movable disconnect switch contact being positioned for selective engagement with each other as said carriage moves to the switch-closed position.

12. The switchgear of claim 11, wherein said carriage translates in a direction parallel to the longitudinal axis of said circuit breaker module.

13. The switchgear of claim 11, wherein said fixed disconnect switch contact and said movable disconnect switch contact comprise a visible disconnect switch.

14. The switchgear of claim 11, wherein:

said switch actuator comprises a link; and which further comprises a main switch actuator linked via said switch actuator to said carriage so as to open and close said fixed and movable disconnect switch contacts when moved in one direction or another between a switch-open position and a switch-closed position.

15. The switchgear of claim 14, which further comprises a mechanical interlock mechanism driven by said main switch actuator and connected so as to force movement of said externally-connectable mechanical drive so as to cause said circuit breaker contacts to open as said main switch actuator begins to move from its switch-closed position to its switch-open position.

* * * * *